US008870404B1

(12) United States Patent
Chen

(10) Patent No.: US 8,870,404 B1
(45) Date of Patent: Oct. 28, 2014

(54) DUAL-VOLTAGE LIGHTED ARTIFICIAL TREE

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

(21) Appl. No.: 14/178,562

(22) Filed: Feb. 12, 2014

Related U.S. Application Data

(60) Provisional application No. 61/911,217, filed on Dec. 3, 2013.

(51) Int. Cl.
*F21S 6/00* (2006.01)
*F21S 4/00* (2006.01)

(52) U.S. Cl.
CPC ..... *F21S 4/001* (2013.01); *Y10S 362/806* (2013.01); *Y10S 362/807* (2013.01)
USPC ..... 362/123; 362/249.02; 362/806; 362/807; 29/825; 403/359.1

(58) Field of Classification Search
USPC ..... 362/123, 806, 807, 252, 659; 29/825; 428/20; 403/359.1, 359.3
See application file for complete search history.

(56) References Cited

U.S. PATENT DOCUMENTS

| | | | |
|---|---|---|---|
| 1,656,148 | A | 1/1928 | Harris |
| 1,677,972 | A | 7/1928 | Marks |
| 1,895,656 | A | 1/1933 | Gadke |
| 2,050,364 | A | 8/1936 | Morton |
| 2,072,337 | A | 3/1937 | Kamm |
| 2,484,813 | A | 10/1949 | Waltz |
| 2,806,938 | A | 9/1957 | Henry |
| 2,969,456 | A | 1/1961 | Raymaley |
| 3,115,435 | A | 12/1963 | Abramson |
| 3,118,617 | A | 1/1964 | Hellrich |
| 3,214,318 | A | 10/1965 | Snow |

(Continued)

FOREIGN PATENT DOCUMENTS

| | | |
|---|---|---|
| CN | 1181693 | 5/1998 |
| CN | 1509670 | 7/2004 |

(Continued)

OTHER PUBLICATIONS

Application and File History for U.S. Appl. No. 13/112,650, filed May 20, 2011, inventor Chen.

(Continued)

*Primary Examiner* — Ali Alavi
(74) *Attorney, Agent, or Firm* — Christensen Fonder P.A.

(57) ABSTRACT

An artificial tree having a first tree section including a trunk and a trunk electrical connector, the trunk electrical connector including a first pair of electric terminals and a second pair of electrical terminals; and a second tree section including a trunk, a trunk electrical connector, and a light string, the trunk electrical connector in electrical connection with the light string and including a first pair of electric terminals and a second pair of electrical terminals. The first tree section is configured to electrically connect to the second tree section, such that the first pairs of electrical terminals of the first and second tree sections conduct power of a first type and the second pairs of electrical connectors of the first and second tree sections conduct power of a second type.

30 Claims, 11 Drawing Sheets

(56) References Cited

U.S. PATENT DOCUMENTS 3,214,579 A 10/1965 Pacini
3,296,430 A 1/1967 Eckert
3,504,169 A 3/1970 Freeburger
3,571,586 A 3/1971 Duckworth
3,616,107 A 10/1971 Kershner
3,617,732 A 11/1971 Fisher
3,704,366 A 11/1972 Korb et al.
3,783,437 A 1/1974 Graff et al.
3,806,399 A 4/1974 Cocjin
3,970,834 A * 7/1976 Smith ..... 362/123
3,985,924 A 10/1976 Pritza
4,020,201 A 4/1977 Miller
4,072,857 A 2/1978 DeVicaris
4,097,917 A 6/1978 McCaslin
4,140,823 A 2/1979 Weskamp
4,493,523 A 1/1985 Leong et al.
4,516,193 A 5/1985 Murphy
4,631,650 A 12/1986 Ahroni
4,753,600 A 6/1988 Williams
4,777,573 A 10/1988 Liao
4,779,177 A 10/1988 Ahroni
4,805,075 A 2/1989 Damore
4,807,098 A 2/1989 Ahroni
4,855,880 A 8/1989 Mancusi Jr.
4,859,205 A 8/1989 Fritz
4,899,266 A 2/1990 Ahroni
5,033,976 A 7/1991 Sarian et al.
5,104,608 A 4/1992 Pickering
5,109,324 A 4/1992 Ahroni
5,121,310 A 6/1992 Ahroni
5,218,233 A 6/1993 Takahashi
5,281,158 A 1/1994 Lin
5,342,661 A 8/1994 Wilcox, II
5,442,258 A 8/1995 Shibata
5,453,664 A 9/1995 Harris
5,455,750 A 10/1995 Davis et al.
5,456,620 A 10/1995 Kaminski
5,481,444 A 1/1996 Schultz
5,550,720 A 8/1996 Carroll
5,560,975 A 10/1996 Casper
5,580,159 A 12/1996 Liu
5,586,905 A 12/1996 Marshall et al.
5,652,032 A 7/1997 Kaczor et al.
5,702,262 A 12/1997 Brown et al.
5,707,136 A 1/1998 Byers
5,709,457 A 1/1998 Hara
5,720,544 A 2/1998 Shu
5,722,766 A 3/1998 Shu
5,776,559 A 7/1998 Woolford
5,788,361 A 8/1998 Lee
5,791,765 A 8/1998 Lin
5,791,940 A 8/1998 Chen et al.
5,807,134 A 9/1998 Hara
5,816,849 A 10/1998 Schmidt
5,816,862 A 10/1998 Tseng
5,820,248 A 10/1998 Ferguson
5,828,183 A 10/1998 Wang
5,829,865 A 11/1998 Ahroni
5,834,901 A 11/1998 Shen
5,839,819 A 11/1998 Pan
5,848,838 A 12/1998 Presta
5,852,348 A 12/1998 Lin
5,854,541 A 12/1998 Chou
5,855,705 A 1/1999 Gauthier
5,860,731 A 1/1999 Martinez
5,860,830 A 1/1999 Wu
5,893,634 A 4/1999 Wang
5,908,238 A 6/1999 Huang
5,921,806 A 7/1999 Shuey
6,004,006 A 12/1999 Wang
6,030,670 A 2/2000 Chang
6,053,774 A 4/2000 Lin
6,056,427 A 5/2000 Kao
6,079,848 A 6/2000 Ahroni
6,084,357 A 7/2000 Janning
6,111,201 A 8/2000 Drane et al.
6,113,430 A 9/2000 Wu
6,116,563 A 9/2000 Tsai
6,123,433 A 9/2000 Chen
6,147,367 A 11/2000 Yang et al.
6,155,697 A 12/2000 Ahroni
6,162,515 A 12/2000 Hill
6,203,169 B1 3/2001 Coushaine et al.
6,257,740 B1 7/2001 Gibboney, Jr.
6,257,793 B1 7/2001 Lin
6,273,584 B1 8/2001 Wang et al.
6,283,797 B1 9/2001 Wu
6,347,965 B1 2/2002 Pan
6,354,719 B1 3/2002 Pan
6,361,368 B1 3/2002 Tseng
6,457,839 B1 10/2002 Grndoit
6,458,435 B1 10/2002 Lai
6,514,581 B1 2/2003 Gregory
6,533,437 B1 3/2003 Ahroni
6,541,800 B2 4/2003 Barnett et al.
6,544,070 B1 4/2003 Radliff
6,580,182 B2 6/2003 Janning
6,588,914 B1 7/2003 Tang
6,595,657 B1 7/2003 Shieh
6,609,814 B2 8/2003 Ahroni
6,634,766 B1 10/2003 Gordon
6,644,836 B1 11/2003 Adams
D486,385 S 2/2004 Smith-Kielland et al.
6,752,512 B2 6/2004 Pan
6,794,825 B1 9/2004 Kao
6,805,463 B2 10/2004 Shieh
6,840,655 B2 1/2005 Shen
6,883,951 B2 * 4/2005 Wu ..... 362/565
6,908,215 B2 6/2005 Wu
6,929,383 B1 8/2005 Janning
6,942,355 B1 9/2005 Castiglia
6,951,405 B2 10/2005 Yao
7,045,965 B2 5/2006 Li et al.
7,052,156 B2 5/2006 Primeau
7,055,980 B2 6/2006 Wu
7,055,981 B2 6/2006 Yao
7,132,139 B2 11/2006 Yang
7,235,815 B2 6/2007 Wang
7,253,556 B1 8/2007 Gibboney
7,264,392 B2 9/2007 Massabki et al.
7,445,824 B2 11/2008 Leung et al.
7,581,870 B2 9/2009 Massabki et al.
7,585,552 B2 9/2009 Meseke
7,695,298 B2 4/2010 Arndt et al.
7,893,627 B2 2/2011 Li
8,007,129 B2 8/2011 Yang
8,053,042 B1 11/2011 Loomis
8,062,718 B2 11/2011 Schooley
8,100,546 B2 1/2012 Lutz et al.
8,298,633 B1 10/2012 Chen
D678,211 S 3/2013 Chen
8,454,186 B2 * 6/2013 Chen ..... 362/123
8,454,187 B2 * 6/2013 Chen ..... 362/123
D686,523 S 7/2013 Chen
8,569,960 B2 10/2013 Chen
D696,153 S 12/2013 Chen
2002/0097573 A1 7/2002 Shen
2002/0118540 A1 8/2002 Ingrassia
2002/0149936 A1 10/2002 Mueller et al.
2003/0142494 A1 7/2003 Ahroni
2003/0198048 A1 10/2003 Frederick
2003/0206412 A1 11/2003 Gordon
2004/0004435 A1 1/2004 Hsu
2004/0012950 A1 1/2004 Pan
2004/0090770 A1 5/2004 Primeau
2004/0096596 A1 5/2004 Palmer, III et al.
2004/0105270 A1 6/2004 Shieh
2005/0048226 A1 3/2005 Gary et al.
2005/0077525 A1 4/2005 Lynch et al.
2005/0122723 A1 6/2005 Frederick
2005/0249892 A1 11/2005 Rocheleau
2005/0286267 A1 12/2005 Wang
2006/0164834 A1 7/2006 Kao
2007/0092664 A1 4/2007 Chun

(56) References Cited

U.S. PATENT DOCUMENTS

| | | | | |
|---|---|---|---|---|
| 2007/0177402 | A1 | 8/2007 | Wu | |
| 2007/0230174 | A1* | 10/2007 | Hicks et al. | 362/252 |
| 2007/0253191 | A1 | 11/2007 | Chin et al. | |
| 2008/0007951 | A1 | 1/2008 | Chan | |
| 2008/0025024 | A1 | 1/2008 | Yu | |
| 2008/0186731 | A1 | 8/2008 | Graham | |
| 2008/0186740 | A1 | 8/2008 | Huang et al. | |
| 2008/0205020 | A1 | 8/2008 | Vich | |
| 2008/0303446 | A1 | 12/2008 | Ding | |
| 2009/0002991 | A1 | 1/2009 | Huang | |
| 2009/0059578 | A1 | 3/2009 | Lau | |
| 2009/0289560 | A1 | 11/2009 | Oliva | |
| 2010/0000065 | A1 | 1/2010 | Cheng et al. | |
| 2010/0053991 | A1 | 3/2010 | Boggs | |
| 2010/0072747 | A1 | 3/2010 | Krize | |
| 2010/0195332 | A1 | 8/2010 | Wasem | |
| 2010/0196628 | A1 | 8/2010 | Shooley | |
| 2011/0062875 | A1 | 3/2011 | Altamura | |
| 2011/0076425 | A1 | 3/2011 | Cheng et al. | |
| 2011/0215368 | A1 | 9/2011 | Chen | |
| 2011/0286223 | A1 | 11/2011 | Chen | |
| 2011/0303939 | A1 | 12/2011 | Chen | |
| 2011/0305022 | A1 | 12/2011 | Chen | |
| 2012/0009360 | A1 | 1/2012 | Fu et al. | |
| 2012/0075863 | A1 | 3/2012 | Chen | |
| 2012/0076957 | A1 | 3/2012 | Chen | |
| 2012/0236546 | A1 | 9/2012 | Chen | |

FOREIGN PATENT DOCUMENTS

| | | | |
|---|---|---|---|
| CN | 2751226 | Y | 1/2006 |
| CN | 200187701 | | 1/2009 |
| DE | 8436328 | | 4/1985 |
| DE | 102 35 081 | A1 | 2/2004 |
| GB | 1150390 | | 4/1969 |
| GB | 1245214 | | 9/1971 |
| GB | 2 137 086 | A | 10/1984 |
| GB | 2172135 | | 9/1986 |
| GB | 2396686 | | 6/2004 |
| WO | WO 91/10093 | | 7/1991 |
| WO | WO 96/24966 | | 9/1996 |
| WO | WO9626661 | A1 | 9/1996 |

OTHER PUBLICATIONS

Application and File History for U.S. Appl. No. 12/157,136, filed Jun. 5, 2008 inventor Wu et al.
Application and File History for U.S. Appl. No. 90/012,209, filed Mar. 26, 2012 inventor.
Application and File History for U.S. Appl. No. 13/112,749, filed May 20, 2011, inventor Chen.
Application and File History for U.S. Appl. No. 13/461,432, filed May 1, 2012, inventor Chen.
Application and File History for U.S. Appl. No. 13/718,028, filed Dec. 18, 2012 inventor Chen.
Application and File History for U.S. Appl. No. 13/962,084, filed Aug. 8, 2013, inventor Johnny Chen.
Application and File History for U.S. Appl. No. 12/157,136, filed Jun. 5, 2008, inventor Johnny Chen.
Application and File History for U.S. Appl. No. 90/012,209, filed Mar. 24, 2012, inventor Johnny Chen.
Application and File History for U.S. Appl. No. 13/710,003, filed Dec. 10, 2012, inventor Johnny Chen.
Application and File History for U.S. Appl. No. 14/171,407, filed Feb. 3, 2014, inventor Johnny Chen.
Application and File History for U.S. Appl. No. 14/171,429, filed Feb. 3, 2014, inventor Johnny Chen.
Application and File History for U.S. Appl. No. 13/112,650, filed May 20, 2011, inventor Johnny Chen.
U.S. Appl. No. 90/020,073, filed Jul. 7, 2014, Patent No. 8,454,186.
U.S. Appl. No. 90/020,074, filed Jul. 14, 2014, Patent No. 8,454,187.
Petition for *Inter Partes* Review of USPN 8,454,186, Case No. IPR2014-01263, filed Aug. 8, 2014.
Petition for *Inter Partes* Review of USPN 8,454,187, Case No. IPR2014-01264, filed Aug. 8, 2014.

* cited by examiner

DUAL-VOLTAGE LIGHTED ARTIFICIAL TREE

The present application claims the benefit of U.S. Provisional Application No. 61/911,217 filed Dec. 3, 2013, which is incorporated herein by reference in its entirety.

FIELD OF THE INVENTION

The present invention is generally directed to lighted artificial trees. More specifically, the present invention is directed to lighted artificial trees having dual-voltage features.

BACKGROUND OF THE INVENTION

Traditional lighted artificial trees typically utilize multiple strings of incandescent bulbs distributed about the branches of the tree. Power plugs from the various strings of lights may be plugged into one another, with many being plugged into an external power source, such as a 110-120V alternating-current (AC) source. Such traditional trees may also include a tree-top ornament set atop the uppermost portion of the tree, or may include other lighted or musical ornaments placed on other parts of the tree. Lit tree-top ornaments typically also include a power cord and plug that needs to be connected to an external power source. Often, such a lit tree-top ornament may be plugged into a power receptacle or end connector of one of the strings of lights so as to provide power to lights in the tree-top ornament.

The growing use of light-emitting diodes (LEDs) in decorative light strings, including those placed onto lighted artificial trees means that many lighted trees include a power transformer to convert or transform household power, such as 110 or 120VAC, to direct-current (DC) power for the LED-based light strings. Such a configuration reduces the overall power consumption of the tree lights, and may provide other benefits to a user.

However, many consumers still own and continue to purchase ornaments, including tree-top ornaments that operate on AC power, not DC power. This means that if an AC-powered ornament is to be used on an LED-based tree having DC-powered light strings, dedicated power cords need to be added to the decorated, lit tree in order to provide power to the additional electrically-powered ornaments and decorations.

SUMMARY

Embodiments of the claimed invention overcome the shortcomings of the prior art by providing dual-voltage power lighted artificial trees that are configured to provide power of a first type and a second type. Power of a first voltage or type, such as AC power, may be distributed from the bottom of the tree to the top of the tree, and made accessible through an accessory power receptacle near a top portion of the tree. Power of a second voltage, or type, such as DC power is distributed throughout the tree and between tree sections, so as to provide power to the lights of the tree.

In an embodiment, the invention comprises an artificial tree, having: a first tree section including a trunk and a trunk electrical connector, the trunk electrical connector including a first pair of electric terminals, including a first electrical terminal and a second electrical terminal, and a second pair of electrical terminals comprising a third electrical terminal and a fourth electrical terminal; and a second tree section including a trunk, a trunk electrical connector, and a light string, the trunk electrical connector in electrical connection with the light string, the trunk electrical connector including a first pair of electric terminals, including a fifth electrical terminal and a sixth electrical terminal and a second pair of electrical terminals, including a seventh electrical terminal and an eighth electrical terminal; wherein the first tree section is configured to couple to the second tree section causing an electrical connection to be made between the first tree section and the second tree section, and the first pairs of electrical terminals of the first and second tree sections conduct power of a first type and the second pairs of electrical connectors of the first and second tree sections conduct power of a second type.

In an embodiment, the power of the first type comprises an alternating current power and the power of the second type comprises a direct current power.

In another embodiment, the artificial tree comprises: a first tree section including: a trunk defining a trunk cavity; a wire assembly, including a power cord, a first plurality of conductors and a second plurality of conductors, the wire assembly housed at least in part within the trunk cavity of the trunk; power-conditioning circuitry, including a power transformer for transforming power of a first type to power of a second type, the power-conditioning circuitry in electrical connection with the power cord and the second plurality of conductors; a plurality of light-emitting elements electrically connected to the second plurality of conductors and configured to receive power of the second type; and an accessory power receptacle in electrical connection with the second plurality of conductors and configured to receive power of the first type.

In another embodiment, the artificial tree comprises: a first tree section including a first trunk defining a first end and a second end, a power cord, a power converter, and a first electrical connector located at least in part within a cavity of the first trunk at the second end, the electrical connector including at least a first electrical terminal, a second electrical terminal, and a third electrical terminal, the power converter electrically connected to the power cord and configured to receive incoming power having a first voltage and convert the incoming power to a power having a second voltage, the first terminal in electrical connection with the power converter to receive the power having the second voltage, the third electrical terminal in electrical connection with the power cord and receiving the power having the first voltage; and a second tree section defining a first end and a second end, and including a second trunk and a second electrical connector located at a first end of the second trunk and including at least a fourth electrical terminal, a fifth electrical terminal, and a sixth electrical terminal, the first end of the second trunk connectable to the second end of the first tree section such that the first electrical terminal is in electrical connection with the fourth electrical terminal, the second electrical terminal is in electrical connection with the fifth electrical terminal, and the third electrical terminal is in electrical connection with the sixth electrical terminal, thereby causing power having a first voltage and power having a second voltage to be transmitted to the second tree section when the power cord receives the incoming power and the first tree section is coupled to the second tree section along a common central axis.

In another embodiment, the artificial tree comprises: a power cord having a first conductor and a second conductor; power conditioning circuitry in electrical communication with the first conductor and the second conductor of the power cord, the power conditioning circuitry configured to receive power having a first voltage, convert the power having a first voltage to a power having a second, lower voltage, and output the power to a first lower-voltage conductor having a first electrical polarity and to a second lower-voltage conductor having a second electrical polarity; a first tree section including a trunk defining a central axis and a trunk electrical connector, the trunk electrical connector including a first, second, third, and fourth electrical terminal, the first terminal in electrical connection with the first lower-voltage conductor, the second terminal in electrical connection with the second lower-voltage conductor, the third terminal in electrical connection with the first conductor of the power cord, and the fourth terminal in electrical connection with the second conductor of the power cord; and a second tree section including a trunk, a trunk electrical connector, and a light string, the trunk electrical connector including a fifth electrical terminal, a sixth electrical terminal, a seventh electrical terminal and an eighth electrical terminal, the light string electrically connected to the fifth and sixth electrical terminals; and a power receptacle electrically connected to the seventh and eighth electrical terminals; wherein the first tree section is configured to couple to the second tree section along the central axis such that an electrical connection is made between the trunk electrical connector of the first tree section and the trunk electrical connector of the second tree section, such that the first conductor and the second conductor of the power cord are in electrical connection with the power receptacle, and the first lower-voltage conductor and the second lower-voltage conductor are in electrical connection with the light string.

In another embodiment, the artificial tree comprises: a first tree section including a trunk, wiring assembly and trunk electrical connector; a second tree section including a trunk, wiring assembly and trunk electrical connector; wherein the trunk electrical connector is configured to couple to the second trunk electrical connector such that a first polarity electrical terminal of the first trunk electrical connector makes initial electrical connection with a first polarity electrical terminal of the trunk electrical connector of the second tree section when a second polarity electrical terminal of the first trunk electrical connector makes initial electrical connection with a second polarity electrical terminal of the second trunk electrical connector of the second tree section.

In another embodiment, the artificial tree comprises: a first tree section having electrical wiring inside a trunk; a second tree section having electrical wiring inside a trunk; wherein the electrical wiring of the first tree section is in electrical connection with the electrical wiring of the second tree section, and provides power to light strings of the first and second tree section, and to a power-plug receptacle of the second tree section.

In another embodiment, the invention comprises a tree coupling system for a set of lighted artificial trees, the system including: a first lighted artificial tree having a first pair of trunk connectors coupling a first tree section to a second tree section; a second lighted artificial tree having a second pair of trunk connectors coupling a first tree section to a second tree section; wherein the either of the first pair of trunk connectors cannot fully couple with either of the second pair of trunk connectors such that a first tree section of a first tree cannot be coupled to a second tree section of the second tree.

BRIEF DESCRIPTION OF THE FIGURES

The invention can be understood in consideration of the following detailed description of various embodiments of the invention in connection with the accompanying drawings, in which.

Figure 1A:
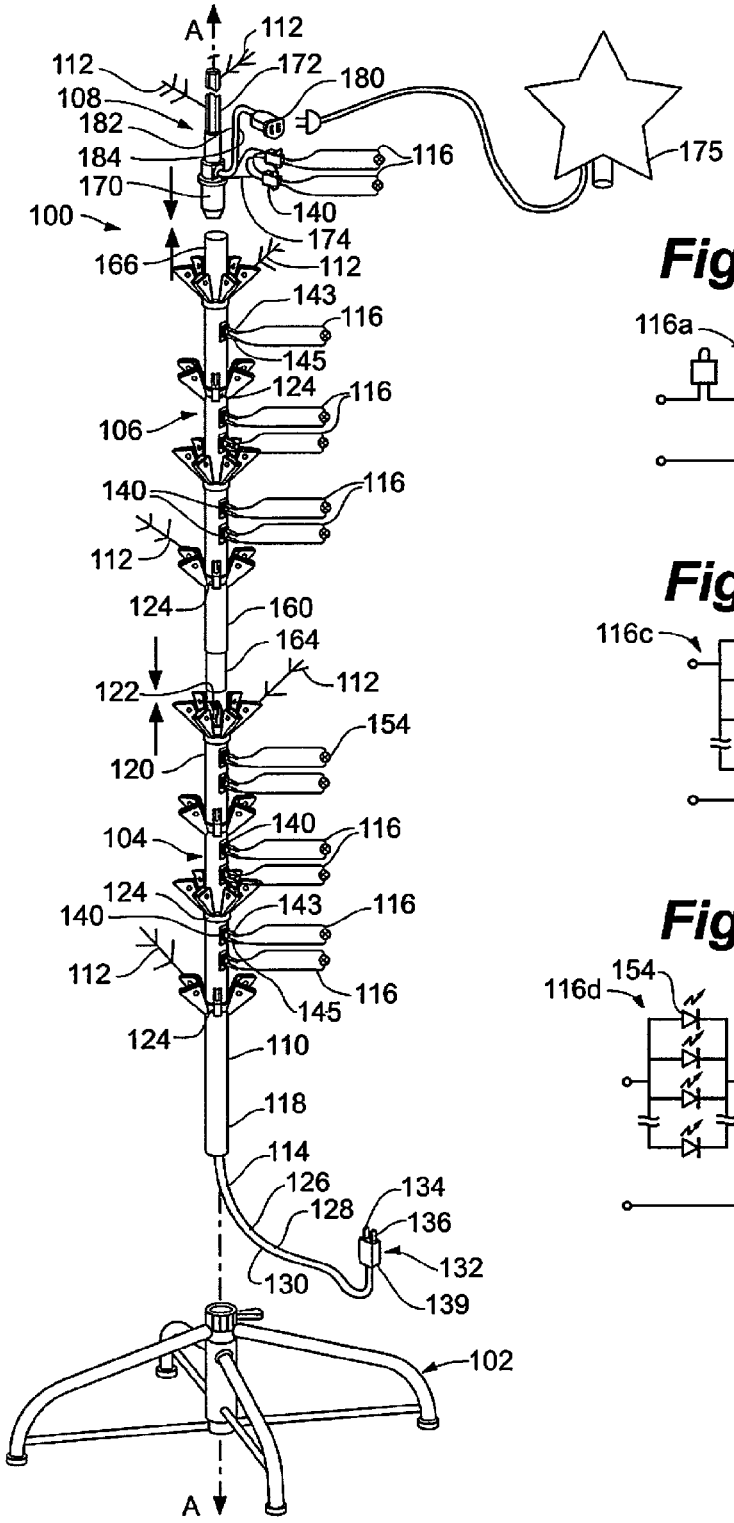
FIG. 1A depicts a dual-voltage lighted artificial tree, according to an embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring to FIGS. 1A-1D, an embodiment of an improved lighted artificial tree 100 with a dual-voltage electrical system is depicted. In an embodiment, and as depicted, tree 100 includes base 102 and a plurality of tree sections, including first tree section 104, second tree section 106, and third tree section 108. Although tree 100 as depicted includes three tree sections, it will be understood that tree 100 may include more or fewer tree sections.

As will be described further in greater detail, tree 100 is configured to receive power from an external power supply, which may be an alternating-current (AC) power source, with power being distributed through trunks of each tree section to power lights distributed about the tree. Embodiments of tree 100, in addition to the features described herein, may also include features described in U.S. Pat. No. 8,434,186 issued Jun. 4, 2013 and entitled Modular Lighted Tree, and US Pub. No. 2013/0163231, published Jun. 27, 2013 and entitled Modular Lighted Artificial Tree, both of which are incorporated by reference herein in their entireties.

Tree section 104 includes trunk portion 110, a plurality of branches 112, wiring assembly 114, and a plurality of decorative light strings 116, each having a plurality, or quantity "N" of lighting elements 154.

In an embodiment, trunk portion 110 defines a generally cylindrical body having proximal or bottom end 118 and distal or top end 120. Bottom end 118 is configured to be received by base 102, thereby securing tree section 104 in a generally vertical orientation along Axis A. Top end 120 is configured to receive a portion of tree section 106, as will be described further below. Trunk portion 110 may define a generally hollow body, or alternatively, may be partially hollow, defining trunk cavity 122. In an embodiment, cavity 116 extends from bottom end 112 to top end 114.

Branches 112 are coupled to trunk portion 110, and extend outwardly and away from trunk portion 110. In an embodiment, branches 112 may be coupled to trunk portion 110 via branch rings 124 in a configuration that allows pivoting of branches 112 about rings 124.

Wiring assembly 114, in an embodiment, includes power cord portion 126. Power cord 126, in an embodiment, includes first conductor 128, which may be of a first electrical polarity, second conductor 130, which may be of a second, or opposite electrical polarity, and power plug 132. It will be understood that reference to first and second electrical polarities generally refers to a positive polarity and a negative polarity (or vice versa) for DC power. For AC power, it will be understood that electrical polarity constantly changes positive to negative at each of the first conductor 128 and second conductor 130. As such, reference to first and second electrical polarities is not meant to limit the conductors to DC power only, but is terminology used to distinguish the conductors and to apply to use of any power type. Power plug 132, in an embodiment, includes first electrical terminal 134, second electrical terminal 136, and housing 139. In an embodiment, power plug 132 may include a fuse 138. First electrical terminal 134 is electrically connected to first conductor 128, through fuse 138 when present; second electrical terminal 136 is electrically connected to second conductor 130. In an embodiment in which tree 100 receives alternating-current (AC) power, first conductor 128 conducts a "line", "hot", or positive electrical signal, while second conductor 130 conducts a neutral or ground electrical signal.

As described further below with respect to FIG. 2, wiring assembly 114 also includes a wiring portion located within trunk cavity 122 and may also include multiple light-string connector assemblies 140 that may be connected to and/or extend outside trunk portion 110. Light strings 116 are configured to attached to light-string connector assemblies 140 so as to electrically connect each light string 116 to a source of power from inside trunk portion 110.

In an embodiment, wiring assembly 114 may not include light-string connector assemblies 140, but rather, portions of individual light strings extend into trunk portion 110 and make connection to wiring assembly 114. In another embodiment, portions of wiring assembly 114 extend out of trunk portion 110 and connect externally to light strings 116. Referring also to FIG. 2, in an embodiment, and as depicted, each light-string connector assembly 140 includes a first wire 142 having a first electrical polarity and a second wire 144 having a second electrical polarity, as well as connecting terminals 143 and 145. In an embodiment, first wire 142 and terminal 143 are in electrical communication with first power cord wire 128 and second wire 144 and terminal 145 are in electrical communication with second power cord wire 130.

In another embodiment, not depicted, wiring portions 140 also include additional wire electrical connectors electrically connected to first and second wires 142 and 144, respectively. In an embodiment, these additional connectors may comprise lamp sockets that couple with a light string 116, such that the connectors may each include a lamp of light string 116. In an embodiment, additional portions of wiring portions 140 extend from trunk cavity 122 to the outside via an opening in trunk portion 110, such as depicted of tree section 108.

In other embodiments, light-string connectors 140 may comprise other electrical connectors, and may be integrated together to form a single electrical connector. In the depicted configuration of two separate connectors, tree 100 may be configured to include series-connected decorative light strings 116, or series-parallel connected light strings, as described further below.

Light strings 116 are in electrical connection or communication with light string connector assemblies 140. In an embodiment, wiring portions of light-string connectors 140 form a portion of light string 116. In other embodiments, light strings 116 may be detachably coupled to light-string connector assemblies 140 via one or more connectors.

Light strings 116 generally include light string wiring 150, sockets 152 and lighting elements 154. Light string wiring 150 is in electrical connection with wires 146 and 148, and thereby is in electrical communication with power cord 126.

Lighting elements 154 may include any of a variety of lights or lamps, including incandescent bulbs, light-emitting diodes (LEDs), a combination of different lights, lamps or LEDs, and so on. In some embodiments, lighting elements 154 of a common tree 100 may all have the same power requirement. In other embodiments, lighting elements 154 may have differing power requirements, such as a tree 100 that includes both light strings 116 having LEDs and operating on DC power, and light strings 116 having incandescent bulbs and operating on AC power. In another such embodiment, lighting elements may include LEDs operating at a first DC power or voltage, such as 3VDC, and other LEDs operating at a second DC power or voltage, such as 2.5VDC.

Figure 1B:
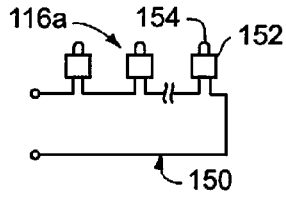
FIG. 1B depicts a light string of the tree of FIG. 1A.
Figure 1C:
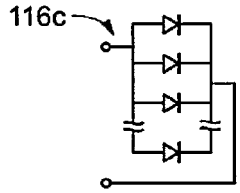
FIG. 1C depicts another light string of the tree of FIG. 1A.
Figure 1D:
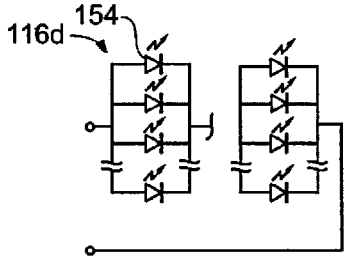
FIG. 1D depicts yet another light string of the tree of FIG. 1A.

Lighting elements 154 may be electrically connected in series, as depicted, such that light string 116 comprises a series-connected light string, such as light string 116*a*, as depicted in FIG. 1B. Lighting elements 154 may also be configured in a series-parallel configuration, such that a first group of lighting elements 154 are electrically configured in series, a second group of lighting elements 154 are electrically connected in series, and the first group and the second group are electrically connected in parallel. In another embodiment, lighting elements 154 are electrically connected in parallel, as depicted of light string 116*c* of FIG. 1C. In another embodiment, groups of lighting elements 154 are electrically connected in parallel, and the groups are electrically connected in series, to form a parallel-series connected light string 116*d*, as depicted in FIG. 1D.

As will be described further below with respect to FIG. 2, tree section 104 also includes a trunk electrical connector for electrically connecting tree section 104 to tree section 106.

Tree section 106 is similar to tree section 104, though tree section 106 but may not include power cord 126, some power conversion and conditioning electronics, and includes a first trunk electrical connector and a second trunk electrical connector, as described below with respect to FIG. 2, to electrically connect tree section 106 to tree sections 104 and 108.

As such, tree section 106 includes trunk portion 160, branches 112, wiring assembly 162, and light strings 116. Similar to tree section 104, and its wiring assembly 114, portions of wiring assembly 162 may extend from inside trunk portion 160 to outside trunk portion 160 so as to electrically connect to light strings 116.

Trunk portion 160 includes first or bottom end 164, second or top end 166, and defines trunk cavity 168. In an embodiment, bottom end 164 may be tapered, or otherwise configured to fit into top end 120 of trunk portion 110 so as to couple trunk portion 110 to trunk portion 160. In other embodiments, top portion 120 may be tapered to fit into bottom portion 164. In other embodiments, other mechanical trunk coupling configurations may be used, including a coupling device that joins the two trunk portions. Other embodiments for coupling the trunk portions may also be used.

Tree section 108, in an embodiment and as depicted may not include a trunk portion similar to trunk portions of tree sections 104 and 106, but rather, may include a trunk connector 170 and a mast 172, as well as wiring assembly 174 and lights 116. In an alternate embodiment, tree section 108 may be similar to tree section 106, and include a trunk portion similar to trunk portion 160, rather than connector 170 and mast 172.

In an embodiment, trunk connector 170 mechanically and electrically connects tree section 108 to tree section 106, and is configured to be inserted into top end 166 of tree section 106.

In an embodiment, mast 172 is coupled to connector 170 and supports branches 112. In an embodiment, mast 172 comprises a plastic material. Mast 172 may generally comprise an outside diameter that is smaller than an outside diameter of trunk portions 110 and 160, and in an embodiment, may be configured to receive at a top end an optional electrified tree-top ornament 175.

Wiring assembly 174, in addition to wiring and connectors for light strings 116, may also include an accessory power connector 180 for supplying power to tree-top ornament 175. Accessory power connector 180, in an embodiment includes first wire 182, second wire 184, and receptacle 186. First and second wires 182 and 184 are in electrical connection with power cord 114 to receive power from an external source, which may provide power not only to light strings 116, but also to tree-top ornament 175, or other accessories added to tree 100. Power receptacle 186 includes a pair electrical terminals electrically connected to wires 182 and 184, and which are configured to make contact with the electrical terminals of a power plug of tree-top 174, or another electrified accessory.

In an embodiment, wires 182 and 184 extend outside of a trunk portion or connector of tree section 108, connecting to power receptacle 186, which is also located external to tree section 108. In an alternate embodiment, wires 182 and 184 are wholly inside a trunk cavity or connector of tree section 108, and power receptacle 186 is adjacent to a trunk or connector of tree section 108. In on such embodiment, receptacle 186 is partially within and partially outside a trunk portion or connector of tree section 108, such that the receptacle is secured to the trunk or connector of tree section 108, and the pair of electrical terminals of the receptacle are accessible to a user to plug in the lighted ornamental accessory 175.

As will be described further below with respect to FIG. 2, in an embodiment, dual-voltage tree 100 provides two types of power, which may have two different voltages, available to electrified elements, such as light strings 116 and ornaments 175. In one such embodiment, an accessory power connector provides AC power to connected devices, while light string connectors of each tree section provide DC power to connected devices. In one such embodiment, accessory power connector 180 provides AC power, such as 120VAC to tree-top ornament 175, while tree sections 106 and 108 and their respective light-string connectors 140 provide DC power, such as 24VDC, to LED-based light strings 116.

Figure 2:
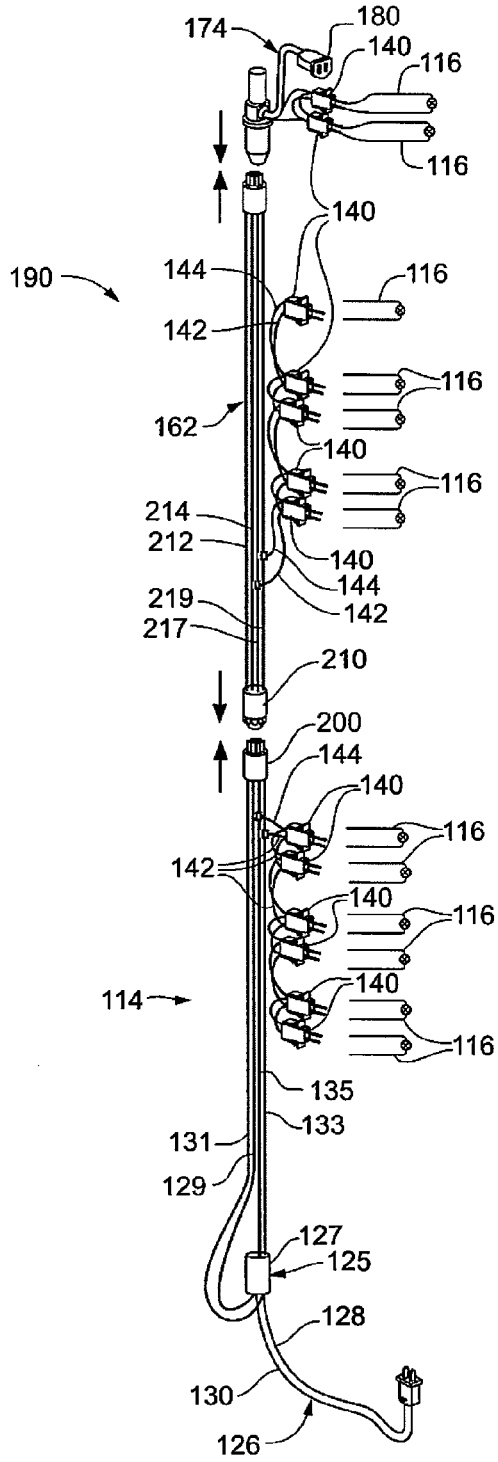
FIG. 2 depicts a wiring system of the tree of FIG. 1A, according to an embodiment of the invention.

Referring to FIG. 2, an embodiment of wiring assemblies of tree 100, comprising tree wiring system 190, are depicted. Tree wiring system 190 includes first wire assembly 114, second wire assembly 162, and third wire assembly 174.

Figure 3:
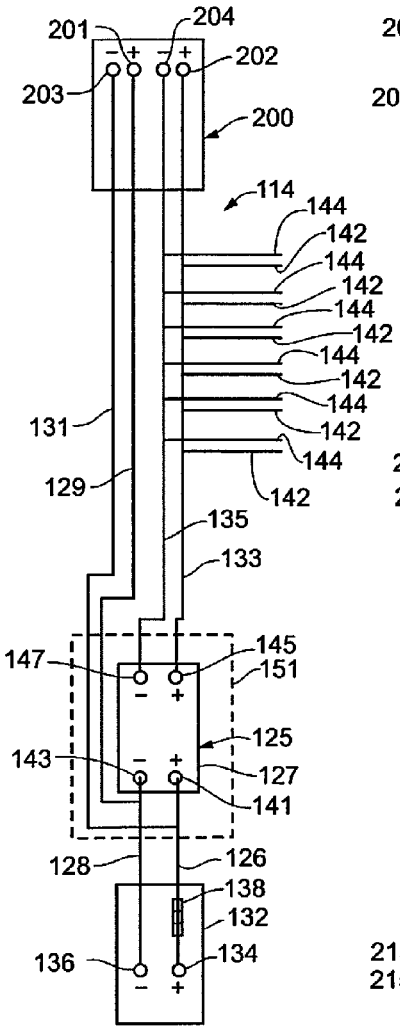
FIG. 3 is an electrical schematic of a first tree section of the tree of FIG. 1 A.

Referring also to FIG. 3, depicting an electrical schematic of wire assembly 114, wire assembly 114 includes wiring having primary or first-voltage-type power wires 128 and 130 (of power cord 126), multiple sets of light string connection assemblies 140, each with a first wire 142 and a second wire 144, and trunk electrical connector 200.

In an embodiment, assembly 114 may also include power conditioning circuitry 125, which may comprise a power transformer, adapter, or converter, as well as other power-conditioning electronics.

As depicted, power-conditioning circuitry 125 comprises transformer 127, which in an embodiment comprises an AC-to-DC power transformer. In one such embodiment, transformer 127 converts 120VAC power to a DC power, such as 3VDC, 9VDC, 24VDC, or other DC voltage.

In an alternate embodiment, power conditioning circuitry 125 may include more than one transformer so as to provide two or more different types of power to tree 100, such as, though not limited to, 9VDC and 24VDC.

Wiring assembly 114 also includes additional primary power wires 129 and 131 conducting a first power type, and main light-string power wires or bus wires 133 and 135 conducting a second power type. Primary power wires 129 and 131 generally comprise a first electrical polarity wire and a second electrical polarity wire, respectively, and conduct or transmit power of a first type, such as AC power, from power cord 126 up to trunk electrical connector 200.

Consequently, power plug terminal 134, wire 126, and wire 129 are in electrical connection, conducting a first polarity electrical signal from power plug 132 to connector 200; power plug terminal 136, wire 128, and wire 131 are in electrical connection, conducting a second polarity electrical signal from power plug 132 to electrical connector 200. As such, power of a first type, which may be AC power, is transmitted from power plug 126 through tree section 104, and to the top of tree section 104 at first trunk connector 200.

In an embodiment, power conditioning circuitry 125 may be located within trunk cavity 122 or outside of trunk cavity 122. In an embodiment of the latter, power conditioning circuitry 125 or transformer 127 may be located outside of trunk portion 110 and between power plug 132 and trunk portion 110. In another embodiment, power-conditioning circuitry 125 may be integrated into power plug 132. In such an embodiment, power plug 132 may output two pairs of power wires to tree section 104, one pair transmitting power of a first type, such as AC power, and another pair transmitting power of a second type, such as DC power.

In an embodiment, wire 126 may be connected to wire 129, and wire 128 may be connected to wire 131 inside housing 151 that is common to power conditioning circuitry 125.

Primary power wires 126 and 128 also electrically connect to power-conditioning circuitry 125 and/or transformer 125 at connection points or terminals 141 and 143. Incoming first-type power is converted or transformed into outgoing second-type power at an output of transformer 127 at connection points or terminals 145 and 147. In an embodiment, AC power at an input to transformer 127 may be converted to DC power at the output of transformer 127.

Power of a second type, such as DC power is transmitted from power conditioning circuitry 125 to wires 133 and 135, which in turn is transmitted to wire pairs 142 and 144 so as to power light strings 116.

Electrical connector 200, as described further below, also includes two pairs of electrical terminals, a first pair conducting power of a first power type comprising terminals 201 and 203, and a second pair conducting power of a second power type comprising terminals 202 and 204. In such an embodiment, electrical connector 200 comprises a four-terminal connector, or four-pin connector. Terminals 201 to 204 are in electrical connection with wires 129, 131, 133, and 135, respectively, of wiring assembly 214, and are configured to electrically connect to wiring assembly 162 when tree section 104 is coupled to tree section 106.

In other embodiments, electrical connector 200 may include more or fewer terminals, such as three terminals, five terminals, six terminals, or more as needed. In one such embodiment, electrical connector 200 includes more terminals, such as an additional pair of terminals for conducting a third power, for a six-terminal connector, which may be the same either of the power types conducted by the other terminal pairs as described above. In another such embodiment, electrical connector 200 includes additional terminals for conducting communication or control signals for communicating with, or controlling, some or all of the light strings of tree 100.

In an embodiment not depicted, electrical connector 200 may include a trunk fuse that is electrically in line with wire 129, which is generally a live or hot conductor.

Primary fuse 138 protects against excessive current draw occurring in any portion of tree 100. Such excessive current draw could be the result of shorting of primary power wires, defective or malfunctioning light strings and so on. A tree-section fuse, when present, provides an additional degree of over-current protection for tree 100 by protecting against excessive current draw in any device electrically connected to wires 129 and 130, or against overcurrent occurring when a foreign object comes into contact with electric terminals of connector 200 or other wiring carrying a first power type.

Light-string power wires 133 and 135, transmitting first polarity power and second polarity power, respectively, to light strings 116, may generally traverse the length of trunk portion 110, connecting to pairs of light string wires 142 and 144 inside, or in some embodiments, outside trunk portion 110. Electrical connection of wires 142 and 144 to main or bus light string power wires 133 and 135 may be made at a connector 140, or may be made by a wire-to-wire connection apart from connectors 140, such as via crimping, soldering, and so on.

Figure 4:
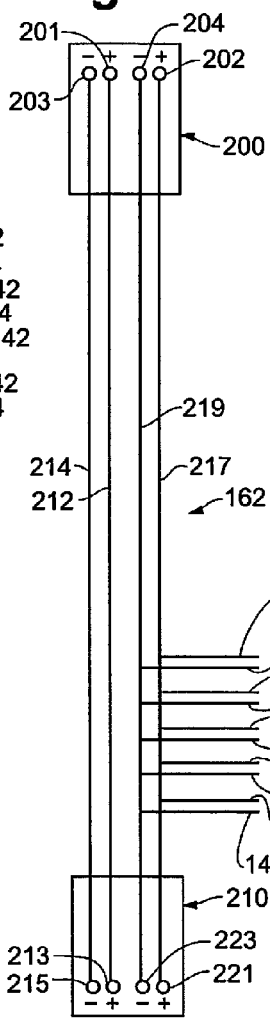
FIG. 4 is an electrical schematic of a second tree section of the tree of FIG. 1 A.

Referring to FIGS. 2 and 4, second wiring assembly 162 is similar to first wiring assembly 114, although in an embodiment second wiring assembly 162 does not include power cord 126 nor power conditioning circuitry 125.

In an embodiment, second wiring assembly 162 includes trunk electrical connectors 200 and 210, which will be described further below, first power-type power wires 212 and 214, second power-type or voltage-type power wires 217 and 219, light-string connector assemblies 140 with pairs of light-string wire portions 142 and 144.

As will be described further below, trunk electrical connector 210 is electrically similar to trunk electrical connector 200. Trunk electrical connector 210 may include a tree-section fuse (not depicted), and two pairs of conductive electrical terminals, a first pair 213 and 215 configured to electrically connect to terminals 202 and 204 via wires 212 and 214, respectively, so as to make electrical connection between tree sections 104 and 106, such that power of a first type is transmitted from primary power wires 128 and 130 to power wires 212 and 214, respectively, and a second pair of terminals 221 and 223 configured to electrically connect to terminals 202 and 204, respectively, such that power of a second type is transmitted from power wires 133 and 135 to power wires 217 and 219 of connector 200 of tree section 106. The mechanical features of trunk electrical connector 210 will be described further below.

Power wires 217 and 219 are electrically connected to light strings 116 of tree section 106 via pairs of light-string power wires 142 and 144.

Consequently, power or voltage of a first type is conducted through tree section 106, and power or voltage of a second type is also conducted through tree section 106, and provides second-type power to light strings 116.

Figure 5:
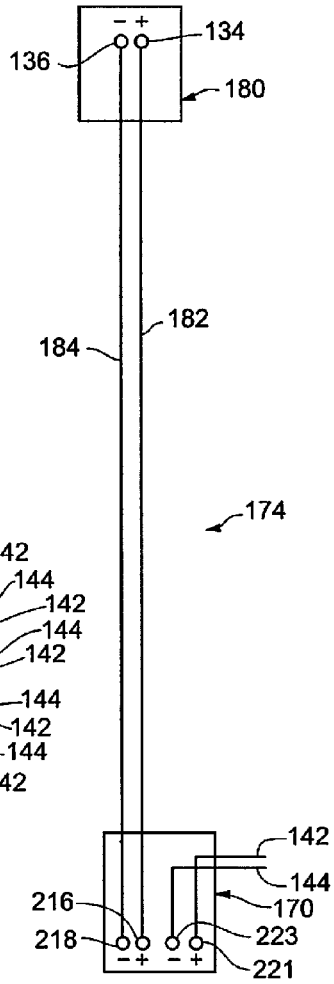
FIG. 5 is an electrical schematic of a third tree section of the tree of FIG. 1 A.

Referring to FIGS. 2 and 5, wiring assembly 174 includes power wires 182 and 184, which in an embodiment, are live, hot, or positive, and neutral, ground, or negative, respectively, thereby providing first-type power from terminals 216 and 218 to power-plug receptacle 180. Wiring assembly 174 includes power-plug receptacle 180 and light-string wiring 140. Wiring assembly 174 may also include a fuse 206 located within end connector power receptacle 180 or within connector 170, in line or series with power wire 134 and terminal 216.

Wiring assembly 114 also includes terminals 221 and 223 electrically connected to one or more light-string power wires 142 and 144, thereby providing power of a second type to light strings 116 of tree section 108.

Consequently, when tree sections 104, 106, and 108 are coupled together, wiring assemblies 114, 162, and 174 are in electrical connection, and power or voltage of a first type is transmitted from power cord 126 throughout tree 100, providing power to accessory power-plug receptacle 180 (and individual tree sections in some embodiments, which may or may not also include additional power-plug receptacles 180), and power or voltage of a second type is transmitted from power conditioning circuitry 125 to each tree section 104, 106, and 108 and their respective light strings 116.

In an embodiment, wiring assemblies 114 and/or 162 may also include an accessory power-plug receptacle 180.

Referring to FIGS. 6-11, an embodiment of trunk electrical connector 200 is depicted. Trunk electrical connector 200 functions as an electrical hub connector, securing wiring inside a trunk cavity, making multiple electrical connections to light strings, and providing dual-voltage or dual-power connection to adjacent tree sections. Although a hub-style trunk electrical connector 200 is depicted and describe herein, it will be understood that other styles of electrical connectors with alternate wiring arrangements and connections are envisioned and included within the scope of the invention.

Herein, trunk electrical connector 200 may be referred to as a "female" electrical connector, but it will be understood that embodiments of trunk electrical connector 200 are not intended to be limited to connectors having only "female" electrical terminals or other "female" mechanical features.

The depicted wiring assembly will be referenced as wiring assembly 114, though it will be understood that multiple trunk electrical connectors 200 may be used in a single tree 100, such that a connector 200 may be connected to other wiring assemblies other than wiring assembly 114.

In an embodiment, and as depicted, trunk electrical connector 200 includes a first pair of electrical terminals comprising first polarity electrical terminal 201 and second polarity electrical terminal 203 and configured to conduct first voltage power, a second pair of electrical terminals comprising first polarity electrical terminal 202 and second polarity electrical terminal 204, housing 220, terminal retainer 222 and end cap 224. Electrical terminals are depicted and described further below with respect to FIGS. 12-16. In an embodiment, trunk electrical connector 200 may also include a fuse 206 in line with a line electrical terminal. Housing 220 in an embodiment comprises a generally cylindrically shape defining a generally circular cross-sectional shape, such that housing 220 may be inserted into a trunk body 121 or 161 receiving cavity. In other embodiments, housing 220 may comprise other shapes adapted to fit into trunk body 121 or 161.

In an embodiment, housing 220 comprises a generally non-conductive material such as polypropylene, polyethylene, nylon, and so on.

Housing 220 includes proximal end 310 and distal end 226 and defines wire-retainer cavity 228 and first terminal cavity 230. As depicted, distal end 224 includes projecting wall 232, a plurality of tooth-like projections 234 circumferentially distributed about, and upon, surface 236. In an embodiment, projections or teeth 234 are equidistantly spaced so as to facilitate universal coupling with projections of an associated connector. As will be explained further below, when coupled with connector 210 having similar tooth-like projections, connectors 200 and 210 will generally be rotationally locked relative to one another.

Housing 220 may also define one or more locating bores 231 used to pin or secure a rotational and axial position of connector 200 to a trunk portion. In an embodiment, an inward projecting "dent" or protrusion in a wall of a trunk portion is received by a bore 231 to secure housing 220 and connector 200. In another embodiment, a fastener is inserted through a wall of a trunk portion and through a bore 231 to secure housing 220 relative to a trunk portion.

Terminal retainer 222 in an embodiment comprises a non-conductive or insulating material, and includes distal end 240 and proximal end 242. Terminal retainer 222, in an embodiment, comprises a generally disc-like shape. As depicted, terminal retainer 222 defines wire receiving cavity 244, and is configured to support, and maintain separation between, terminals 201 to 204.

Figure 29:
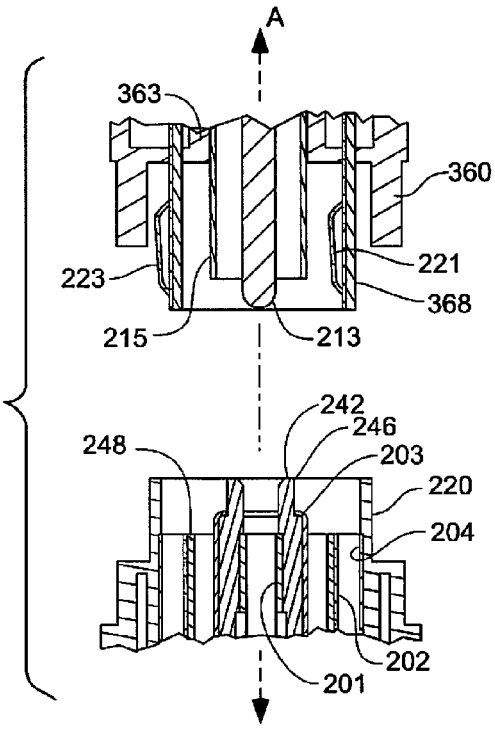
FIG. 29 is a cross-sectional view of a housing and electrical terminal pair of a female trunk electrical connector and a housing and electrical terminal pair of a male trunk electrical connector, according to an embodiment of the invention.
Figure 31:
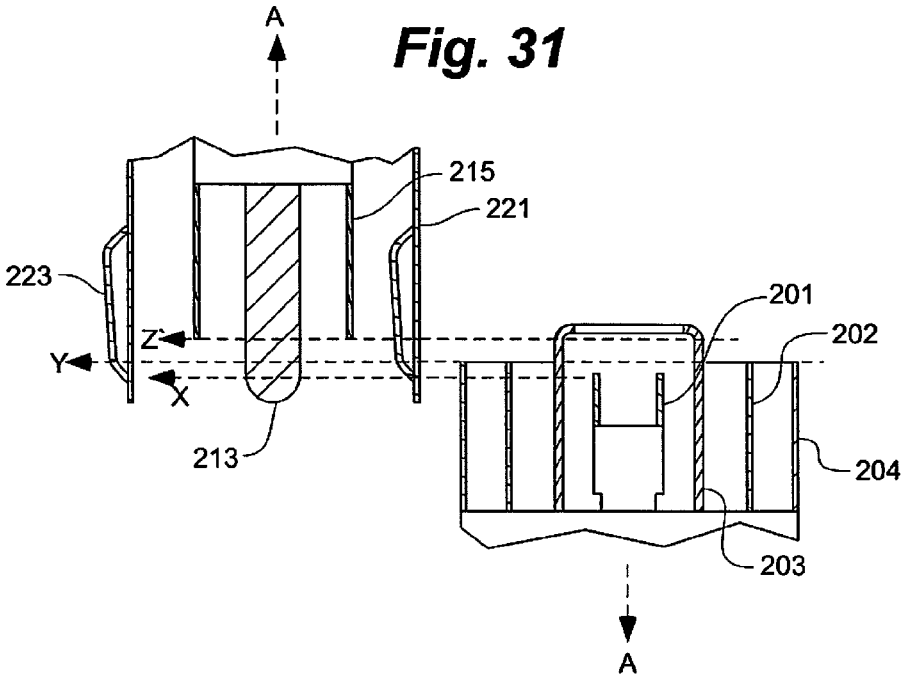

Referring also to FIGS. 29 and 31, terminal retainer 222 also includes first isolating wall 246 and second isolating wall 248 for isolating or separating, as well as supporting, terminals 201 to 204. In an embodiment, first isolating wall 246 projects axially, upwardly and away from proximal end 242 of terminal retainer 222 and housing 220, forming a cylindrical shape. In an embodiment, first isolating wall 246 is centered about Axis A. In an embodiment, isolating wall 246 may project axially in an amount equal to the axial projection of housing 220.

Second isolating wall 248, in an embodiment, may be concentric to first isolating wall 246, also projecting axially, upwardly and away from proximal end 242 of terminal retainer 222, forming a generally cylindrical shape. In an embodiment, and as depicted, second isolating wall 248 does not project as far axially as wall 246.

Terminal retainer 222 is received by housing 220.

Cap 224 is received by housing 220. End cap 224 comprises a generally non-conductive material, includes base portion 252 and a plurality of upwardly projecting extensions 254, and defines wire aperture 256. End cap 224 is configured to couple to housing 220 and in an embodiment to terminal retainer 222. In an embodiment end cap 224 fits via a snap fit into housing 220, such that one or more tabs 253 of cap 224 fits into one or more slots 311 of housing 220.

Referring to FIGS. 12-16, embodiments of electrical terminals 201 to 204 are depicted.

In an embodiment, electrical terminal 201 includes wire-connection portion 279, plate portion 280 with optional ears 282 and upper portion 284 with optional securing tabs 285. In an embodiment, wire-connection portion 279 is coupled to plate portion 280, which is coupled to upper portion 284.

Wire-connection portion 279 is configured, in an embodiment, to be crimped, soldered, or otherwise connected to a conductive portion of a wire, such as wire 129 or 212. Ears 282 may be coplanar to other portions of plate portion 280, and are configured to be received by terminal retainer 222 or in some embodiments by housing 220, so as to assist in securing terminal 201 to terminal retainer 222 and/or housing 220.

In an embodiment, upper portion 284 comprises a cylindrical shape formed by wall 286 having inside surface 288 and outside surface 290 and defining terminal-receiving cavity 292. When connector 202 is coupled to connector 210, terminal-receiving cavity 292 receives a portion of terminal 213, which contacts inside surface 288, thereby making an electrical connection between terminal 202 of connector 200 and terminal 213 of connector 210.

In an embodiment, upper portion 284 includes a pair of tabs 294 projecting outwardly from wall 286. When first terminal portion 260 is inserted into wire-retainer 222, tabs 294 contact an inside surface of projection portion 245 of terminal retainer 222, thereby assisting in securing and stabilizing first terminal portion 260 within terminal retainer 222, and stabilizing upper portion 280 to minimize movement when receiving a portion of terminal 210 of connector 210.

In other embodiments, upper portion 284 may comprise other shapes, rather than a cylindrical or tubular shape. In such embodiments, upper portion 284 may comprise a blade, spade, pin, ring, or other such known electrical terminals or electrical connectors, configured to couple to a corresponding electrical terminal 213 of trunk electrical connector 210.

Figure 13:
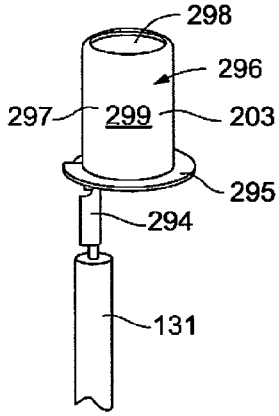
FIG. 13 is a front perspective view of a second electrical terminal of the trunk electrical connector of FIG. 6, according to an embodiment of the invention.

Referring to FIG. 13, terminal 203 includes wire-connection portion 294, and upper portion 296. Wire-connection portion 294 is coupled to upper portion 296 and is configured to crimp, be soldered, or otherwise connected to a conductor of a wire, such as wire 131 or 214.

Upper portion 296, in an embodiment, includes base 295 and contact portion 297, and outside surface 299. In an embodiment, base 295 forms an annular ring, encircling a bottom portion of contact portion 297. In an embodiment, contact portion 297 forms a cylindrical, or barrel shape, and defines cavity 298. Contact portion 297 in other embodiments may form other shapes, similar to those described above with respect to upper portion 284. Contact portion 297 may also include a lip or flare that causes an inside diameter of contact portion 297 to be slightly smaller at a top portion and opening of cavity 298, as compared to the inside diameter of contact portion 297 at a bottom portion. In an embodiment, cavity 298 receives projecting wall 246 of terminal retainer 222, such that the lip of contact portion 297 is in contact with projecting wall 246, thusly assisting in securing terminal 203 to terminal retainer 222.

When trunk electrical connector 200 is coupled to connector 10, outside surface 299 may be in electrical connection with a counterpart terminal of connector 202, as described further below.

In an embodiment, and as depicted, terminals 201 and 203 comprise first and second polarity terminals, respectively, conducting power of a first type, which in an embodiment is an AC power.

Figure 14:
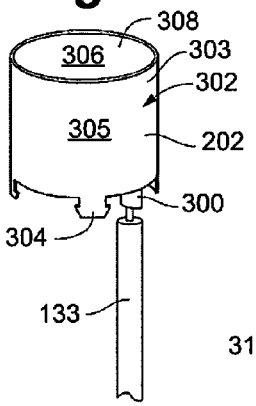
FIG. 14 is a front perspective view of a third electrical terminal of the trunk electrical connector of FIG. 6, according to an embodiment of the invention.

Referring to FIG. 14, an embodiment of electrical terminal 202 is depicted. In this depicted embodiment, terminal 202 includes wire-connection portion 300 and upper portion 302.

Upper portion 302 includes contact portion 303, and in an embodiment, includes securing tabs 304. In an embodiment, contact portion 303 forms a cylindrical or barrel shape having an outside surface 305, inside surface 306, and defines cavity 308. Securing tabs 304 are distributed, in some embodiments, equidistantly, about a bottom portion of contact portion 303, projecting axially downward away from contact portion 303. Tabs 304 may include angled ears, such that tabs 304 may be secured into a corresponding opening or slot of terminal retainer 222, so as to secure terminal 202 to terminal retainer 222.

Figure 15:
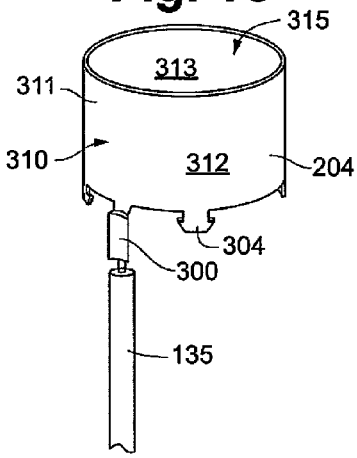
FIG. 15 is a front perspective view of a fourth electrical terminal of the trunk electrical connector of FIG. 6, according to an embodiment of the invention.

Referring to FIG. 15, an embodiment of terminal 204 is depicted. In an embodiment, terminal 204 is substantially the same as terminal 202, though terminal 204 may form a larger contact portion. Terminal 204 includes wire-connection portion 300 and upper portion 310. Upper portion 302 includes contact portion 311 and tabs 304. Upper portion 311 includes outside surface 312, inside surface 313 and defines cavity 315.

Figure 16A:
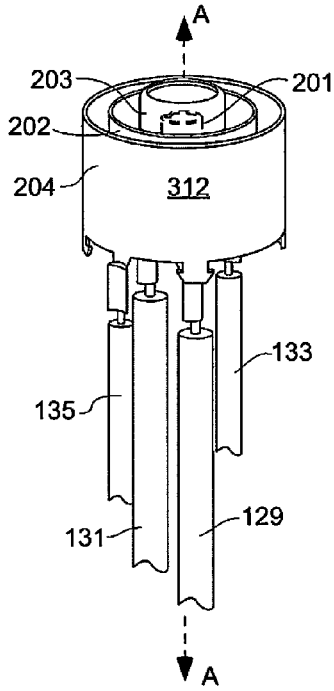
FIG. 16*a* is a front perspective view of the terminals of FIGS. 12-15 and associated connecting wires, according to an embodiment of the invention.

Referring to FIG. 16*a*, terminals 201 to 204 are depicted relative to one another as they would be when secured to terminal portion 222 and housing 220. As depicted, all four terminals, 201, 202, 203, and 204 are concentric about one another and Axis A. In an embodiment, top edges of terminals 202, 203, and 204 are coplanar, while a top edge of 201 lies below the plane formed by the top edges of terminals 202-204.

In such a configuration, power of a first type is conducted in the first two terminals closest to Axis A, namely terminals 201 and 203, while power of a second type is conducted in the two terminals furthest from Axis A, namely terminals 202 and 204.

Figure 16B:
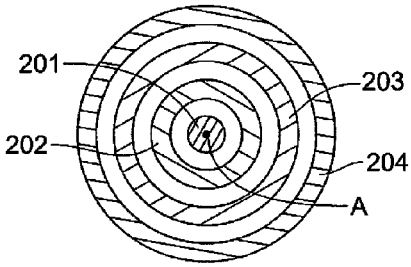
FIG. 16*b* is top plan view of alternate embodiments of terminals for a trunk electrical connector.
Figure 16C:
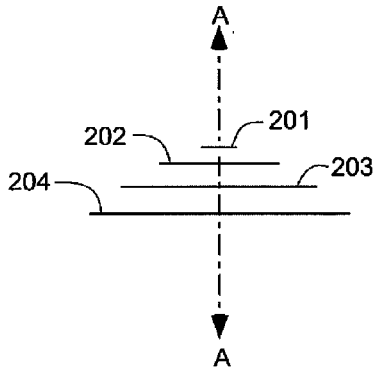
FIG. 16*c* is side view of the terminals for a trunk electrical connector as depicted in FIG. 16*b;*
Figure 18:
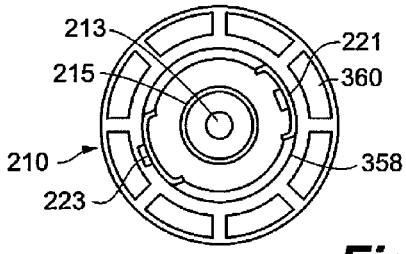
FIG. 18 is a top view of the trunk electrical connector of FIG. 17.

Referring to FIGS. 16*b* and 16*c*, in an alternate embodiment, terminal 201 comprises a flat, circular conductive portion, while terminals 202, 203, and 204 comprise annular ring portions. In an embodiment, and as depicted, terminals 203 to 204 are concentric about one another, and about axis A. In an embodiment comprising flat, concentric terminals 201 to 204, all terminals lie in the same horizontal plane. In another embodiment, and as depicted in FIG. 16*c*, one or more of terminals 201 to 204 lie in different horizontal planes, such that the possibility of arcing between terminals is reduced.

Referring to FIGS. 17-22, an embodiment of trunk electrical connector 210 is depicted. In an embodiment, trunk electrical connector 210 may be considered a "male" connector, having a portion received by a "female" counterpart of a trunk electrical connector 200.

In an embodiment, trunk electrical connector 210 comprises electrical terminal 213, electrical terminal 215, electrical terminal 221, electrical terminal 223, housing 340, terminal retainer 342 and end cap 344.

In an embodiment, housing 340 is similar to housing 220, with at least the exception of some structural differences at a top portion of housing 340.

Housing 340 in an embodiment comprises a generally cylindrically shape defining a generally circular cross-sectional shape, such that housing 340 may be inserted into a trunk body 121 or 161 receiving cavity. In other embodiments, housing 340 may comprise other shapes adapted to fit into trunk body 121 or 161.

In an embodiment, housing 340 comprises a non-conductive material such as polypropylene, polyethylene, nylon, and so on.

Housing 340 includes proximal end 350 and distal end 352 and defines wire-retainer cavity 354 and first terminal cavity 356. As depicted, distal end 352 includes projecting wall 358 defining a pair of slots or channels 359, a plurality of tooth-like projections 360 circumferentially distributed about, and upon, surface 362, and terminal-support portion 363. As will be explained further below, when coupled with connector 200 having similar tooth-like projections, connectors 200 and 210 will generally be rotationally locked relative to one another.

Housing 340 may also define one or more locating bores 231 used to pin or secure a rotational and axial position of connector 210 relative to a trunk portion. Housing 340 may also define slots 311 to receive one or more tabs of cap 344. Housing 340 may also define one or more bores 365 that receive a portion, such as a pin or projection, or terminal retainer 342, such that terminal retainer 342 is secured to housing 340.

In an embodiment, terminal retainer 342 comprises a non-conductive or insulating material. Terminal retainer 342, in an embodiment, comprises base portion 366 and a pair of terminal supports 368 and 370 for supporting terminals 213 and 215, respectively.

In an embodiment, base portion 366 comprises a generally cylindrical, disk-like, or barrel shaped structure defining a central opening through which electric terminals 213 and 215 extend through.

Terminal supports 368 and 370 are radially offset from a center of terminal support 342, or Axis A, and project upward and away from surface 372 of base portion 366. In an embodiment, terminal supports 368 and 370 may each comprise slots or channels for receiving their respective electrical terminals. In an embodiment, a slot of terminal support 368 faces inward, or has an opening, toward a center of base portion 366, while a slot of terminal support 370 faces outward, or has an opening away from a center of base portion 366.

Terminal retainer 342 is configured to be received by housing 340 in cavity 354. Terminal supports 368 and 370 are received by channels 359, such that terminal supports 368 and 370, in an embodiment, combine with projection 358 to form a substantially contiguous, cylindrical, or otherwise shaped, wall.

End cap 344 in an embodiment is substantially similar to cap 224, and in an embodiment, comprises a generally non-conductive material, includes base portion 370 and a plurality of upwardly projecting extensions 372, and defines wire aperture 374. End cap 224 is configured to couple to housing 340 and in an embodiment to terminal retainer 222. In an embodiment end cap 344 fits via a snap fit into housing 340. Projections 372, in an embodiment, may be configured to fit into slots in housing 340, or otherwise couple to an interior surface of housing 340.

Referring to FIGS. 23-26, embodiments of electrical terminals 213, 215, 221, and 223, are respectively depicted.

Figure 23:
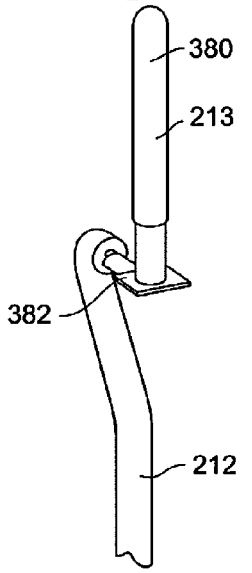
FIG. 23 is a front perspective view of a first electrical terminal of the trunk electrical connector of FIG. 17, according to an embodiment of the invention.

Referring specifically to FIG. 23, in an embodiment, electrical terminal 213 comprises a pin terminal made of conducting material, and including a contact portion 380 coupled to a base or wire-connecting portion 382. Contact portion 380, in an embodiment comprises a pin-like structure, which may be generally cylindrical, and may be generally hollow, solid, or some combination thereof. Wire-connecting portion 382 may be coupled to a conductive portion of a wire, such as wire 212, such that terminal 213 is in electrical connection with wire 212. Connection may be made by crimping portion 382 to a conductor of a wire, by soldering, or otherwise making a mechanical connection resulting in an electrical connection.

Figure 27A:
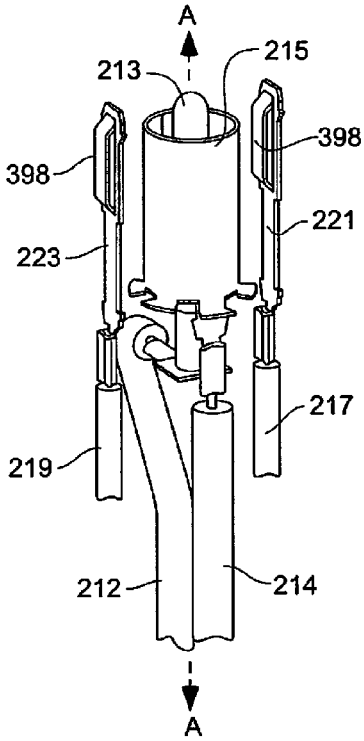
FIG. 27*a* is a front perspective view of the terminals of FIGS. 23-26 and associated connecting wires, according to an embodiment of the invention.
Figure 27B:
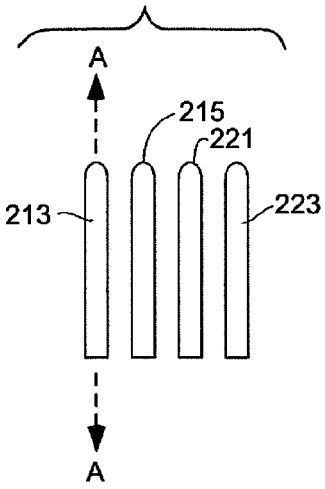
FIG. 27*b* is a side view of an alternate embodiment of terminals for a trunk electrical connector.
Figure 27C:
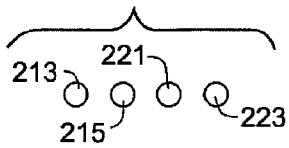
FIG. 27*c* is a top plan view of the terminals of FIG. 27*b;*

In other embodiments, electrical terminal 213 may comprise other shapes or structures, such as a flat shape, ring, and so on, as depicted in FIGS. 27*b* and 27*c*, and as described further below.

Figure 24:
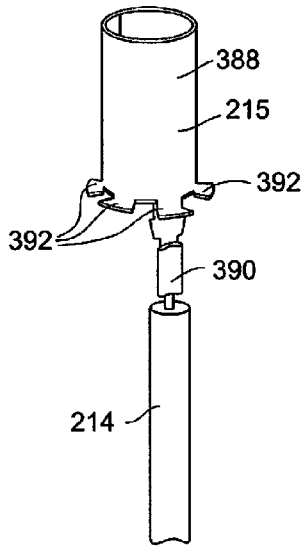
FIG. 24 is a front perspective view of a second electrical terminal of the trunk electrical connector of FIG. 17, according to an embodiment of the invention.

Referring specifically to FIG. 24, in an embodiment, electric terminal 215 comprises a contact portion 388 and wire-connecting portion 390. Electrical terminal 215 may also comprise a plurality of tabs or ears 392 projecting radially from contact portion 388. Tabs 392 may be received by terminal retainer 342 so as to secure terminal 215 to terminal retainer 342.

In an embodiment, contact portion 388 comprises a generally cylindrical shape, such that electrical terminal 213 may project into the central cavity formed by contact portion 388. In other embodiments, contact portion 388 may form other terminal shapes, including rectangular, square, flat and so on.

Figure 25:
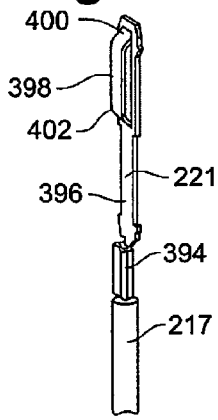
FIG. 25 is a front perspective view of a third electrical terminal of the trunk electrical connector of FIG. 17, according to an embodiment of the invention.

Referring specifically to FIG. 25, electrical terminal 221 includes wire-connection portion 394, body portion 396, and spring portion 398. Wire-connection portion 394 is configured to connect to a conductor of a wire, such as wire 217: Body portion 396, in an embodiment, and as depicted, generally comprises a flat strip extending axially away from wire-connection portion 394. Spring portion 398 is connected to an end of body portion 396 at a proximal end 400 and is spaced apart from, and disconnected from body portion 396 at a distal end. Spring portion 398 forms a spring-like tab that pivots at end 402, and may be compressed to serve as a spring terminal.

Figure 26:
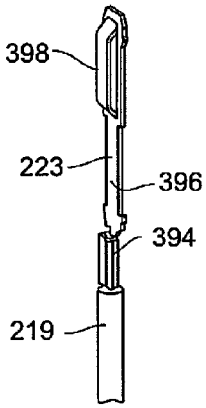
FIG. 26 is a front perspective view of a fourth electrical terminal of the trunk electrical connector of FIG. 17, according to an embodiment of the invention.

Referring specifically to FIG. 26, electrical terminal 223, in an embodiment, is substantially the same as electrical terminal 215. As depicted, wire-connection portion 394 of electrical terminal 223 is connected to a conductor of wire 219, thereby making an electrical connection between terminal 223 and wire 219.

Referring to FIG. 27*a*, terminals 213, 215, 221 and 223 as they would be positioned and secured onto terminal retainer 342, are depicted. Electrical terminal 213 is positioned centrally, and extends axially along Axis A. Electrical terminal 215 surrounds a portion of terminal 213, such that terminals 213 and 215 are coaxial with respect to Axis A. Electrical terminals 213 and 215 may conduct power of a first type, and may respectively comprise a first electrical polarity and a second electrical polarity.

Electrical terminals 221 and 223 are radially offset from Axis A and terminals 213 and 215. In an embodiment, and as depicted, portions of terminals 221 and 223 are not equidistant from a center of the collective terminals, or Axis A. In other words, portions of terminals 221 and 223 are different distances from Axis A. In an embodiment, all portions of terminals 223. may be offset a different distance from Axis A as compared to any portion of terminal 223. In another embodiment, portions of terminal 221 may be equidistant from portions of terminal 223. As depicted spring portions 398 of terminals 221 and 223 are not equidistant from Axis A.

Referring to FIGS. 27*b* (side view) and 27*c* (top plan view), in an alternate embodiment, all or some of terminals 213, 215, 221 and 223 may comprise pin-like terminals. In an embodiment, and as depicted, terminals 213 to 223 may be equidistantly spaced apart, with terminal 213 being aligned along axis A. In other embodiments, terminals 213, 215, 221 and 223 may not be equidistantly spaced, and may be located relative to one another to form other patterns.

Figure 27D:
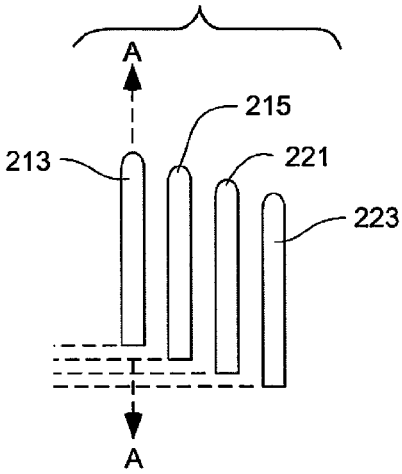
FIG. 27*d* is a side view of an alternate embodiment of the terminals of FIG. 27*b;*

In an embodiment, ends of terminals 213, 215, 221 and 223 may comprise different heights, or may be spaced vertically such that the ends of the terminals lie in different horizontal planes, as depicted in FIG. 27*d*.

In an embodiment, terminals 213, 215, 221 and 223 as depicted in FIGS. 27*b* and 27*c*, and in FIG. 27*d*, may be configured to make electrical connection with terminals 201, 202, 203, and 205, respectively, as depicted in FIGS. 16*b* and 16*c*, respectively. In such an embodiment, ends of terminals 213, 215, 221 and 223 contact surfaces of terminals 201, 202, 203, and 205, respectively.

In embodiments, the symmetrical arrangement of the electrical terminals 201 to 204 and 213 to 223 allow for tree portions, such as tree portion 104 to be coupled to tree portion 106 in any relative rotational orientation or alignment about axis A, and make electrical connection between the two tree sections by means of the electrical terminals coming into electrical connection with one another.

Figure 28:
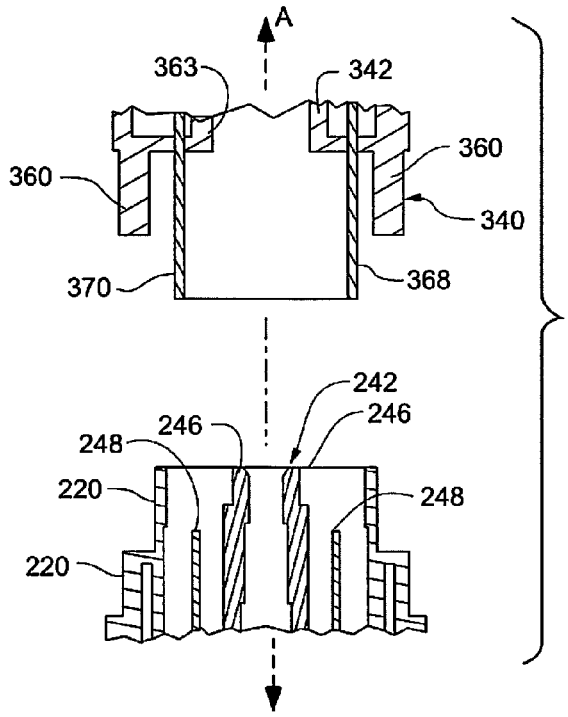
FIG. 28 is a cross-sectional view of a housing of a female trunk electrical connector and a housing of a male trunk electrical connector, according to an embodiment of the invention.

Referring to FIGS. 28 and 29, terminals 201 to 204 of trunk electrical connector 200, and terminals 213, 215, 221 and 223 of trunk electrical connector 210 are depicted as mounted to their respective housings 220 and 340 and terminal retainers 242 and 342.

In both FIGS. 28 and 29, a cross-section of a portion of housing 340 and terminal retainer 342 is depicted above a cross-sectional portion of housing 220 and terminal retainer 242. FIG. 28 depicts housings and retainer without terminals, while FIG. 29 depicts housings and retainers with electrical terminals.

When assembled to trunk electrical connector 200, terminal 201 is seated against an inside surface of first isolating wall 246 of terminal retainer 242, terminal 203 is seated against an outside surface of wall 246, such that projecting portion 246 isolates terminal 201 from 203.

Terminal 202 is seated against an outside surface of second isolating wall 248, while terminal 204 is seated against an inside surface of projecting wall 232 of housing 220.

In an embodiment, top edges of three terminals 201, 202 and 204 are coplanar, and above a plane formed by a top edge of terminal 202.

Terminal 213 is centrally located in terminal retainer 342 and is coaxial with terminal 215. Terminal 215 is seated against an inside surface of support ring 363. Terminal 221 is seated against an inside surface of terminal support portion 368, while terminal 223 is seated against an outside terminal support portion 370.

When trunk electrical connector 200 is coupled to trunk electrical connector 210, terminal 213 is in electrical connection with terminal 201, terminal 215 with terminal 203, terminal 221 with terminal 202, and terminal 223 with terminal 204.

Figure 30:
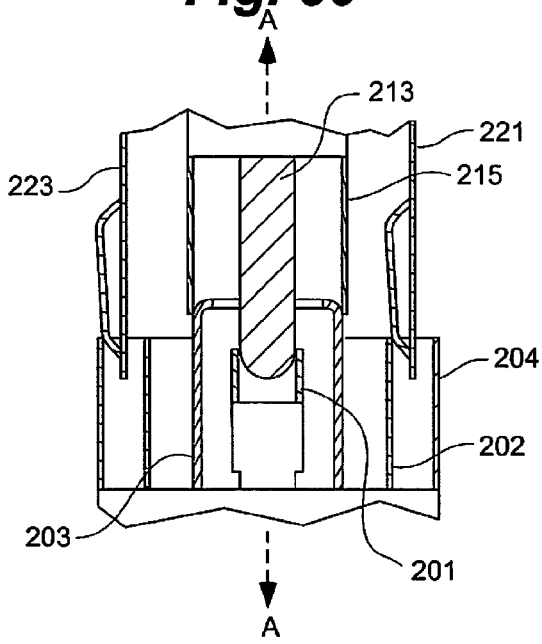
FIGS. 30 and 31 depict an initial electrical connection between electrical terminals of male and female trunk electrical connectors, according to an embodiment of the invention.

Referring to FIGS. 30 and 31, terminals 201 to 204 making initial electrical contact with terminals 213, 215, 221, and 223 are depicted. In an embodiment, and as depicted, all pairs of terminals make initial contact substantially simultaneously. In other words, when one terminal is initially contacting its counterpart terminal, all other terminals are also initially making contact with their counterpart terminals.

In an embodiment, and as depicted, when terminal 213 is initially making electrical contact or connection with terminal 201, terminal 215 is making initial electrical connection with terminal 203, terminal 221 is making initial connection with terminal 202, and terminal 223 is making initial electrical connection with terminal 204. The same applies to "breaking" or disconnection of the terminals. In an embodiment, all pairs of terminals disconnect at substantially the same time and position.

Such an embodiment reduces the possibility of arcing between individual terminals. Conversely, if one pair of, say positive, terminals are in electrical connection, but a corresponding pair of negative terminals are being brought together after the positive terminals are connected, an arc may occur between the negative terminals as they are brought close to one another. Such arcing can create a safety hazard, create overheating or melting of components, or present an electrical shock hazard. Connecting terminals simultaneously, reduces the possibility of this arcing situation.

Referring specifically to FIG. 31, planes X, Y, and Z represent the three planes in which electrical connection between pairs of terminals are made. Planes X, Y, and Z are distributed axially, such that they are spaced apart along Axis A.

Terminals 213 and 215 make initial electrical connection on plane X. Terminals 215 and 203 make electrical connection in plane Z. Planes X and Z are spaced apart axially. This feature also reduces the possibility of arcing between any of terminals 213, 215, 201 and 203 by maximizing the air gap between terminals.

Terminals 221 and 202 make initial electrical connection in plane Y, as do terminals 223 and 204. As plane Y is spaced apart axially from planes X and Z, again, the possibility of unwanted arcing between terminals is reduced.

Not only does such a configuration greatly reduce the possibility of arcing between terminals, but reduces the possibility of a foreign object, such as a user's finger or other object, from being in contact with any, or particularly any pair of electrical terminals.

Figure 6:
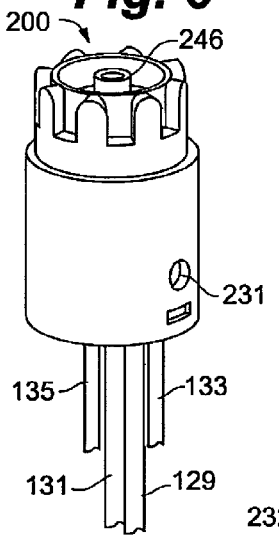
FIG. 6 is a front perspective view of an assembled female trunk electrical connector, according to an embodiment of the invention.
Figure 7:
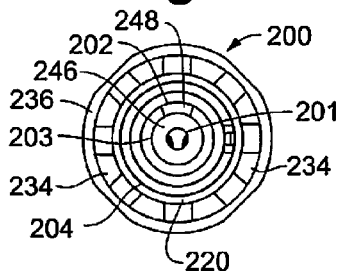
FIG. 7 is a top view of the trunk electrical connector of FIG. 6.
Figure 8:
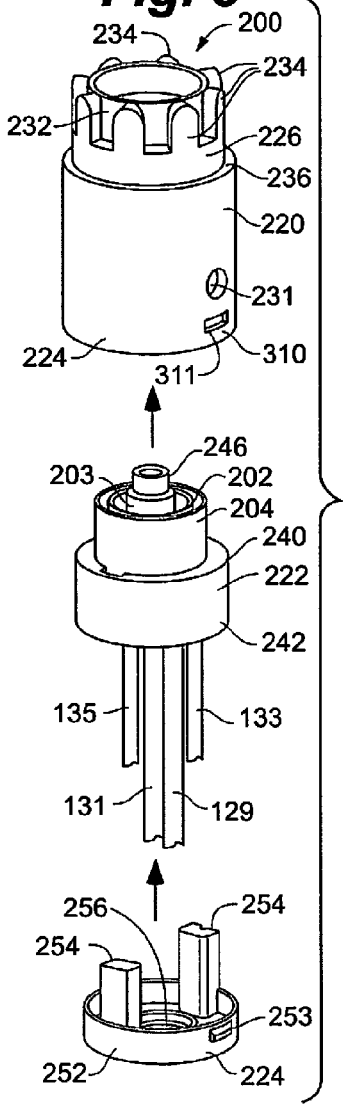
FIG. 8 is an exploded view of the trunk electrical connector of FIG. 6.
Figure 9:
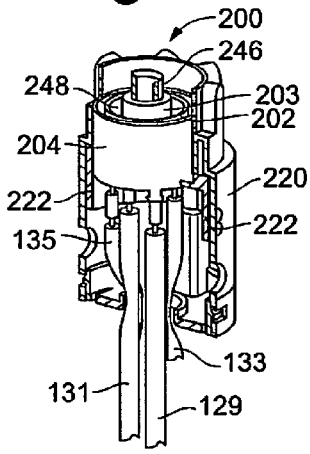
FIG. 9 is a cross-sectional view of the trunk electrical connector of FIG. 6.
Figure 10:
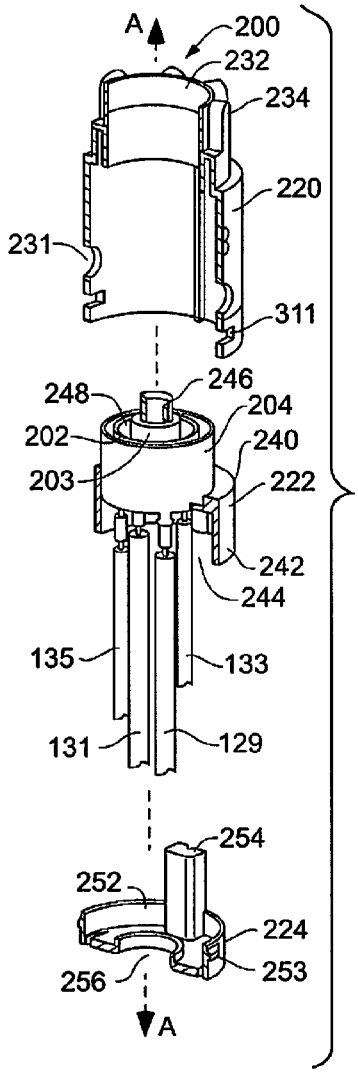
FIG. 10 is an exploded view of the trunk electrical connector of FIG. 6, with a housing and cap depicted in cross-section.
Figure 11:
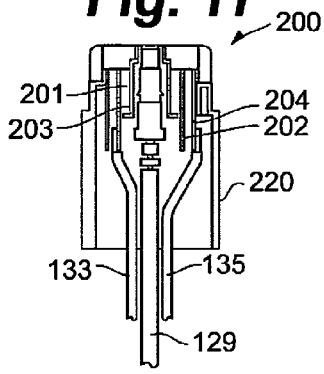
FIG. 11 is a cross-sectional view of the trunk electrical connector of FIG. 6, when assembled.
Figure 12:
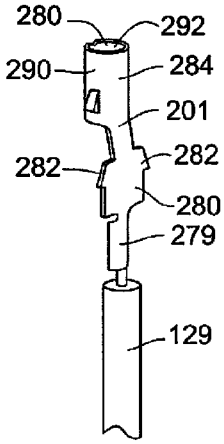
FIG. 12 is a front perspective view of a first electrical terminal of the trunk electrical connector of FIG. 6, according to an embodiment of the invention.
Figure 17:
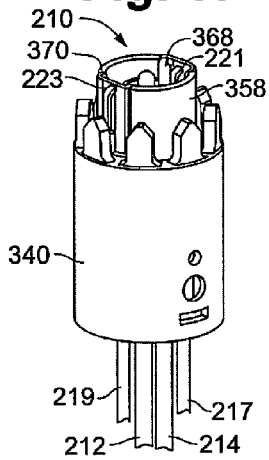
FIG. 17 is a front perspective view of a male trunk electrical connector of the tree of FIG. 1, according to an embodiment of the invention.
Figure 19:
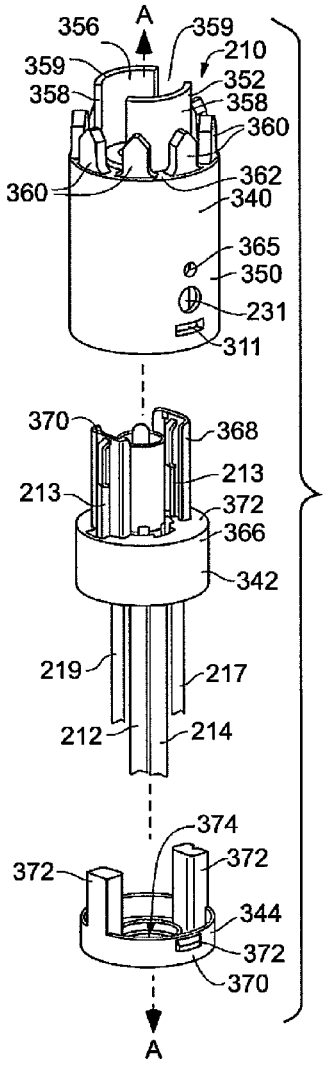
FIG. 19 is an exploded view of the trunk electrical connector of FIG. 17.
Figure 21:
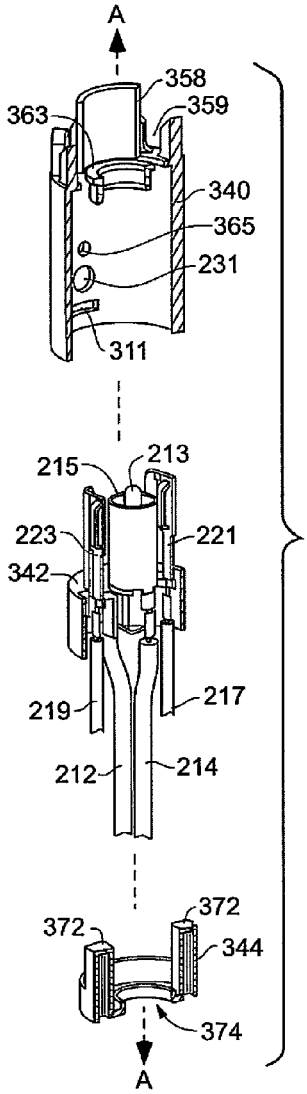
FIG. 21 is an assembled view of the trunk electrical connector of FIG. 17, with the housing and cap in cross section.
Figure 20:
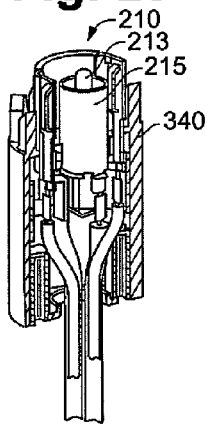
FIG. 20 is an exploded view of the trunk electrical connector of FIG. 17, with a housing and cap depicted in cross section.
Figure 22:
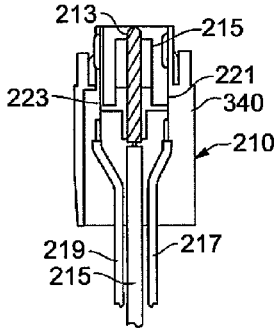
FIG. 22 is a cross-sectional view of the trunk electrical connector of FIG. 17.

Referring to FIGS. 6 and 17, further convenience and safety features of the trunk electrical connection system of the claimed invention are explained and depicted.

Trunk electrical connector 200 comprises a plurality of projections or teeth 234 projecting upwardly and away from surface 236 of housing 220, and adjacent projecting wall 258. Similarly, trunk electrical connector 210 comprises a plurality of projections or teeth 534 projecting upwardly and away from surface 362 of housing 340, and adjacent projecting wall 358.

In general, when housing 220 is coupled to housing 340, teeth 234 are next to, and adjacent, teeth 354, fitting into the gaps formed between teeth 354. However, when housings 220 and 340 are initially meeting during the coupling of a pair of tree sections, such as tree section 104 and 106, housing 220 and housing 340 may not be precisely rotationally aligned such that teeth align with gaps.

In an embodiment, teeth 234 and teeth 354 may be configured such that when they are moved toward one another axially and make contact, one or both of housing 220 and 340 will rotate. Such rotation will be the result, in an embodiment, a tip of a tooth, such as tooth 234, contacting a portion of a corresponding tooth 354, such that the axial force is distributed to a rotational force as the two teeth slide against one another, causing teeth to fit into gaps.

In an embodiment, teeth 354 have a different profile from teeth 234, forming a sharper or more pointed tip, as compared to the relatively rounded tip of teeth 234. The more pointed tips of teeth 354 and their resulting lower area of surface contact, decrease the possibility of teeth 234 and teeth 354 not rotating relative to one another, and increase the likelihood that the two sets of teeth or projections rotate relative to one another, seating teeth into gaps.

Having different profiles or shapes of teeth on the two different trunk electrical connectors thereby aids a user in assembling a pair of trunk sections properly and fully.

In another embodiment, the number and/or shape of teeth 234 or 354 may vary from tree size to tree size, or tree type to tree type, such that tree sections may not be mismatched.

In an embodiment, a tree section coupling system of the claimed invention comprises a set of trees 100. Each tree 100 comprises a particular specification, and its individual tree sections, such as 104, 106, and 108, are not intended to be interchanged with tree sections of trees 100 having different specifications. In one such embodiment, a first tree 100 may be an AC powered tree, while a second tree 100 may be a DC powered tree, and a third tree may conduct both AC and DC. In another embodiment, a first tree 100 may comprise a large number of light strings and lights, such as 1600 lighting elements, while a second tree 100 may comprise fewer lights strings and lights, such as 600 lighting elements.

To prevent tree sections from trees having different electrical or even mechanical specification from being intermingled or interchanged, the number of teeth 234 and 354 on trunk electrical connectors 200 and 210 may vary from tree to tree. In an embodiment, first tree 100 includes eight teeth 234 and eight teeth 254, spaced equidistantly, respectively, such as the embodiments depicted in FIGS. 6 and 17. Another tree having a different specification, which may be a different electrical specification, may have more or fewer than eight teeth per connector, thereby making it difficult or impossible to fully couple a tree section from a first tree to a tree section of a second tree.

In another embodiment, the number of teeth may be the same from tree to tree, but the shape of the tree teeth may vary from tree to tree, again making it difficult or impossible to swap and join tree sections of trees having different specifications.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed:

1. An artificial tree, comprising:

a first tree section including a trunk and a trunk electrical connector, the trunk electrical connector including a first pair of electric terminals in electrical connection with a first plurality of conductors configured to conduct power of a first type, the first pair of electrical terminals including a first electrical terminal and a second electrical terminal, and a second pair of electrical terminals in electrical connection with a second plurality of conductors configured to conduct power of a second type, the second pair of electrical terminals comprising a third electrical terminal and a fourth electrical terminal; a second tree section including a trunk, a trunk electrical connector, and a light string, the trunk electrical connector in electrical connection with the light string, the trunk electrical connector including a first pair of electric terminals in electrical connection with a third plurality of conductors configured to conduct power of the first type, the first pair of electrical terminals including a fifth electrical terminal and a sixth electrical terminal, and a second pair of electrical terminals in electrical connection with a fourth plurality of conductors configured to conduct power of the second type to the light string, the second pair of electric terminals including a seventh electrical terminal and an eighth electrical terminal; and an accessory power receptacle in electrical connection with the third plurality of conductors and configured to receive power of the first type;

wherein the first tree section is configured to couple to the second tree section causing an electrical connection to be made between the first tree section and the second tree section, and the first pairs of electrical terminals of the first and second tree sections conduct power of the first type and the second pairs of electrical connectors of the first and second tree sections conduct power of the second type.

2. The artificial tree of claim 1, wherein the first electrical terminal makes electrical connection with the fifth electrical terminal, the second electrical terminal makes electrical connection with the sixth electrical terminal, the third electrical terminal makes electrical connection with the seventh electrical terminal, and the fourth electrical terminal makes electrical connection with the eighth electrical terminal, when the first tree section is coupled to the second tree section about a common central axis.

3. The artificial tree of claim 1, wherein the power of the first type comprises an alternating current power and the power of the second type comprises a direct current power.

4. The artificial tree of claim 1, wherein the second tree section further comprising an accessory power connector in electrical connection with the fifth electrical terminal and the sixth electrical terminal.

5. The artificial tree of claim 1, wherein the accessory power connector is not in electrical connection with the light string.

6. The artificial tree of claim 1, further comprising a power cord in electrical connection with the trunk electrical connector of the first tree section.

7. The artificial tree of claim 1, further comprising power-conditioning circuitry for converting the power of the first type to the power of the second type.

8. The artificial tree of claim 7, wherein the power-conditioning circuitry is located inside the trunk of the first tree section.

9. The artificial tree of claim 1, wherein the first, second, third, and fourth terminals are
coaxial about a central axis.

10. The artificial tree of claim 1, wherein the first electrical terminal makes electrical connection with the fifth electrical terminal in a first plane, the second electrical terminal makes electrical connection with the sixth electrical terminal in a second plane, and the first plane is axially offset from the second plane.

11. The artificial tree of claim 10, wherein the third electrical terminal makes electrical connection with the seventh electrical terminal in a third plane, and the third plane is axially offset from the first and second planes.

12. An artificial tree, comprising:

a first tree section including:

a trunk defining a trunk cavity;

a wire assembly, including a power cord, a first plurality of conductors and a second plurality of conductors, the wire assembly housed at least in part within the trunk cavity of the trunk;

power-conditioning circuitry, including a power transformer for transforming power of a first type to power of a second type, the power-conditioning circuitry in electrical connection with the power cord and the second plurality of conductors;

a plurality of light-emitting elements electrically connected to the second plurality of conductors and configured to receive power of the second type; and an accessory power receptacle in electrical connection with the first plurality of conductors and configured to receive power of the first type.

13. The artificial tree of claim 12, wherein the power of the first type comprises an alternating-current (AC) power, the power of the second type comprises a direct-current (DC) power, and the light-emitting elements comprise light-emitting diodes.

14. The artificial tree of claim 12, wherein the power of the first type comprises an alternating-current (AC) power, and the power of the second type comprises an AC power, a peak voltage of the power of the second type being less than a peak voltage of the power of the first type.

15. The artificial tree of claim 12, wherein the accessory power receptacle is directly affixed to the trunk.

16. The artificial tree of claim 12, wherein the accessory power receptacle is affixed to a pair of wires extending from the trunk.

17. The artificial tree of claim 12, wherein the plurality of light-emitting elements comprise LEDs that are electrically connected to one another in a parallel configuration.

18. The artificial tree of claim 12, wherein the plurality of light emitting elements comprise LEDs electrically connected to one another in a parallel-series configuration, such that a first group of LEDs is electrically connected to a second group of LEDs, the LEDs of the first group being electrically connected to one another in parallel, and the LEDs of the second group being electrically connected to one another in parallel.

19. The artificial tree of claim 12, further comprising a second tree section including four electrical terminals, the four electrical terminals connectable to four electrical terminals of the first tree section, such that the first tree section is in electrical connection with the second tree section, and both the first tree section and the second tree section transmit power of the first and second types.

20. The artificial tree of claim 12, wherein the four electrical terminals of the first tree section make electrical connection with the four electrical terminals of the second tree section at substantially the same time when the first tree section is connected to the second tree section.

21. An artificial tree, comprising:

a first tree section including a first trunk defining a first end and a second end, a power cord, a power converter, and a first electrical connector located at least in part within a cavity of the first trunk at the second end, the electrical connector including at least a first electrical terminal, a second electrical terminal, and a third electrical terminal, the power converter electrically connected to the power cord and configured to receive incoming power having a first voltage and convert the incoming power to a power having a second voltage, the first terminal in electrical connection with the power converter to receive the power having the second voltage, the third electrical terminal in electrical connection with the power cord and receiving the power having the first voltage;

a second tree section defining a first end and a second end, and including a second trunk and a second electrical connector located at a first end of the second trunk and including at least a fourth electrical terminal, a fifth electrical terminal, and a sixth electrical terminal, the first end of the second trunk connectable to the second end of the first tree section such that the first electrical terminal is in electrical connection with the fourth electrical terminal, the second electrical terminal is in electrical connection with the fifth electrical terminal, and the third electrical terminal is in electrical connection with the sixth electrical terminal, thereby causing power having a first voltage and power having a second voltage to be transmitted to the second tree section when the power cord receives the incoming power and the first tree section is coupled to the second tree section along a common central axis; and a power receptacle configured to receive the power of the first voltage, the power receptacle being in electrical connection with a first conductor and a second conductor, the first and second conductors being in electrical connection with the second trunk electrical connector of the second tree section.

22. The artificial tree of claim 21, wherein the second electrical terminal and the fifth electrical terminal comprise electrically-neutral terminals.

23. The artificial tree of claim 21, wherein the first tree section further includes a seventh electrical terminal and the second tree section further includes an eighth electrical terminal, the seventh electrical terminal electrically connectable to the eighth electrical terminal, each of the seventh electrical terminal and the eighth electrical terminal comprising an electrically-neutral terminal.

24. The artificial tree of claim 21, wherein the first voltage comprises an alternating-current (AC) voltage, and the second voltage comprises a direct-current (DC) voltage.

25. An artificial tree, comprising:

a power cord having a first conductor and a second conductor;

power conditioning circuitry in electrical communication with the first conductor and the second conductor of the power cord, the power conditioning circuitry configured to receive power having a first voltage, convert the power having a first voltage to a power having a second, lower voltage, and output the power to a first lower-voltage conductor having a first electrical polarity and to a second lower-voltage conductor having a second electrical polarity;

a first tree section including a trunk defining a central axis and a trunk electrical connector, the trunk electrical connector including a first, second, third, and fourth electrical terminal, the first terminal in electrical connection with the first lower-voltage conductor, the second terminal in electrical connection with the second lower-voltage conductor, the third terminal in electrical connection with the first conductor of the power cord, and the fourth terminal in electrical connection with the second conductor of the power cord; and a second tree section including a trunk, a trunk electrical connector, and a light string, the trunk electrical connector including a fifth electrical terminal, a sixth electrical terminal, a seventh electrical terminal and an eighth electrical terminal, the light string electrically connected to the fifth and sixth electrical terminals such that the light string is configured to receive the power having the second lower voltage; and a power receptacle electrically connected to the seventh and eighth electrical terminals and configured to receive the power having the first voltage;

wherein the first tree section is configured to couple to the second tree section along the central axis such that an electrical connection is made between the trunk electrical connector of the first tree section and the trunk electrical connector of the second tree section, such that the first conductor and the second conductor of the power cord are in electrical connection with the power receptacle, and the first lower-voltage conductor and the second lower-voltage conductor are in electrical connection with the light string.

26. The artificial tree of claim 25, wherein the first, second, third, and fourth electrical terminals are coaxial about the central axis.

27. The artificial tree of claim 25, further comprising an insulation barrier between the second electrical terminal and the third electrical terminal.

28. The artificial tree of claim 25, wherein at least one of the first, second, third, and fourth terminals projects axially upward a distance further than the other of the first, second, third, and fourth terminals.

29. The artificial tree of claim 25, wherein the first electrical terminal is a pin terminal aligned along the central axis.

30. The artificial tree of claim 25, wherein the light string comprises light-emitting diodes, the first and second lower-voltage conductors are configured to conduct a direct-current voltage, and the first and second conductors of the power cord are configured to conduct an alternating-current voltage.

* * * * *